US005101519A

United States Patent [19]

Yamamoto

[11] Patent Number: 5,101,519

[45] Date of Patent: Apr. 7, 1992

[54] AUTOMATIC CARE-TAKING SYSTEM IN USE FOR BED-RIDDEN PATIENT

[76] Inventor: Tuneo Yamamoto, No. 20, Sirinashi, Tameto-cho, Toyokawa 442, Japan

[21] Appl. No.: 609,085

[22] Filed: Nov. 2, 1990

Related U.S. Application Data

[63] Continuation of Ser. No. 285,014, Dec. 15, 1988, abandoned.

[30] Foreign Application Priority Data

Oct. 13, 1988 [JP] Japan ..... 63-258045

[51] Int. Cl.[5] ..... A47K 3/12

[52] U.S. Cl. ..... 4/300; 4/547; 4/561.1; 5/614

[58] Field of Search ..... 4/560, 561, 562, 563, 4/480, 547, 546; 5/60, 66, 81 R, 61; 128/33

[56] References Cited

U.S. PATENT DOCUMENTS

| | | | |
|---|---|---|---|
| 1,740,906 | 12/1929 | Rothauszky et al. | 5/61 X |
| 2,113,286 | 4/1938 | White | 5/61 |
| 2,522,018 | 9/1950 | Blackman | 5/61 |
| 2,971,204 | 2/1961 | McCoy et al. | 5/61 X |
| 3,317,928 | 5/1967 | Root | 4/561 |
| 3,810,263 | 5/1974 | Taylor et al. | 5/81 R |
| 4,084,274 | 4/1978 | Willis et al. | 5/61 |
| 4,085,471 | 4/1978 | DiMatteo et al. | 5/90 |
| 4,085,472 | 4/1978 | DiMatteo | 5/90 |
| 4,112,524 | 9/1978 | Johansson | 4/148 |
| 4,225,988 | 10/1980 | Cary et al. | 5/61 |
| 4,375,706 | 3/1983 | Finnhult | 5/61 |
| 4,658,450 | 4/1987 | Thompson | 5/61 |
| 4,718,133 | 1/1988 | DiMatteo et al. | 5/81 R |
| 4,726,082 | 2/1988 | DiMatteo et al. | 5/81 R |

FOREIGN PATENT DOCUMENTS

| | | | |
|---|---|---|---|
| 512165 | 10/1930 | Fed. Rep. of Germany | 4/560 |
| 225613 | 8/1985 | German Democratic Rep. | 4/560 |
| 176758 | 10/1961 | Sweden | 5/60 |
| 82/03325 | 10/1982 | World Int. Prop. O. | 5/61 |

*Primary Examiner*—Henry J. Recla
*Assistant Examiner*—Robert M. Fetsuga
*Attorney, Agent, or Firm*—Cooper & Dunham

[57] ABSTRACT

An automatic care-taking system for a bed-ridden patient comprising a bed body having three rectangular, horizontally disposed bed plates arrayed on a bed frame in planar relationship to each other, the three bed plates being pivotally connected to each other, the first bed plate to the second bed plate and the second bed plate to the third bed plate. The pivotally connected bed plates are adapted to be driven by bars and rockable rods. When the rod connecting the first and second bed plates is driven, the first and second bed plates tilt to form a V-shape while the third bed plate remains horizontal. When the bar connecting the second and third bed plates is driven, the second and third bed plates tilt to form a V-shape while the first bed plate remains in a horizontal position.

20 Claims, 19 Drawing Sheets

AUTOMATIC CARE-TAKING SYSTEM IN USE FOR BED-RIDDEN PATIENT

This is a continuation of application Ser. No. 285,014, filed Dec. 15, 1988, now abandoned.

BACKGROUND OF THE INVENTION

1. Field of the Invention

This invention relates to an automatic care-taking system improved so that even a bed-ridden aged patient can look after himself in daily life such as turning over in bed, as well as bathing and treating his own bowel movement without the help of an attendant.

2. Description of the Prior Art

For a bed-ridden patient who is physically unable to move by himself, one of the problems which he suffers from is bedsore (a decubitus ulcer) since he can not change his position in bed with his back always lying on an invariable area.

Further, it usually takes no small help of an attendant to have the patient bathe or finish his bowel movement. With the attendant provided at all times, the patient psychologically feels as if he is a burden of his family particularly when the attendant is one of his family with the patient himself confined to bed for a long period of time. This is very costly first of all, and may eventually force all the family members to lead a gloomy and unpleasant life.

As an example of a care-taking art, the attendant has to hug the patient to carry him to a toilet bowl on which the patient is to be sat, otherwise the toilet bowl has to be carried to a bed in which the patient is confined at the time of bowel movement. At the time of bathing, the patient is carried to a bathing tub with the use of a stretcher or a lift. In the case of the lift in particular, the lift has a net to accommodate the patient, the patient may feel uneasy while he is carried.

This is one of the reasons why the patient becomes reluctant to bath, thus beginning to shed a foul odor from his body.

It is, therefore, an object of this invention to provide an automatic care-taking system for a bed-ridden patient which enables the patient to turn over in bed, and take a bath as well as finish bowel movement by himself substantially without the help of attendant. This enables to reduce a burden of the attendant to a significant degree. The patient can take a bath at his will at any moment to always keep himself clean, protecting himself against bed-ridden related-diseases.

According to this invention, there is provided an automatic care-taking system for use with a bed-ridden patient comprising; a bed body having at least three bed plate pieces horizontally mounted on a bed frame, said bed plate pieces being formed from rollers and a belt extended between said rollers, so that a person lying on said bed body may be transferred outside said bed body, and returned to said bed body from the outside; said three bed plate pieces being first, second and third bed plate pieces in turn, the first and its neighboring second bed plate pieces being pivotally connected at their longitudinal sides, the second and its neighboring third bed plate pieces being pivotally connected at their longitudinal sides, so that the first and second bed plate pieces each rotate downward to form first V-shaped valley therebetween, and the second and third bed plate pieces each rotates downward to form second V-shaped valley therebetween; a drive means which drives to rotate said first and second bed plate pieces downward, and said second and third bed plate pieces downward alternately, so that said person on said bed body can change position to alternately locate at said first V-shaped valley in which said person being with his left side and back side on said first and second bed plate pieces in turn, and second V-shaped valley in which said person being with his right side and backside on said third and second bed plate pieces in turn; said drive means having a ring and a rod, the ring having a female thread at its inner surface while the rod having a female thread at its outer surface, the rod being inserted into the ring through their threads to displace the rod relative to the ring in the lengthwise direction with rotational movement of the rod, displacement of either the rod or the ring being adapted to rotate said first and second bed plate pieces downward, and said second and third bed plate pieces downward alternately; a bathing tub to which warm water is to be supplied when necessary, said bathing tub being located in tandem relationship with said bed body; said rest plate pieces mounted on an upper open end of said bathing tub to lay said person transferred from said bed body, and being divided into at least first, second and third plate section which in turn corresponds to an upper half of said person a hip portion and legs portion; said first and second plate section being pivotally connected, said second and third plate section being pivotally connected, so that said first, second and third plate section move downward through pivoted portions into said bathing tub to change to a chair-shaped configuration so as to soak said person in said warm water in a seated position.

These and other aspects of this invention are more fully described in the following specification and drawings.

DETAILED DESCRIPTION OF THE INVENTION

Figure 1:
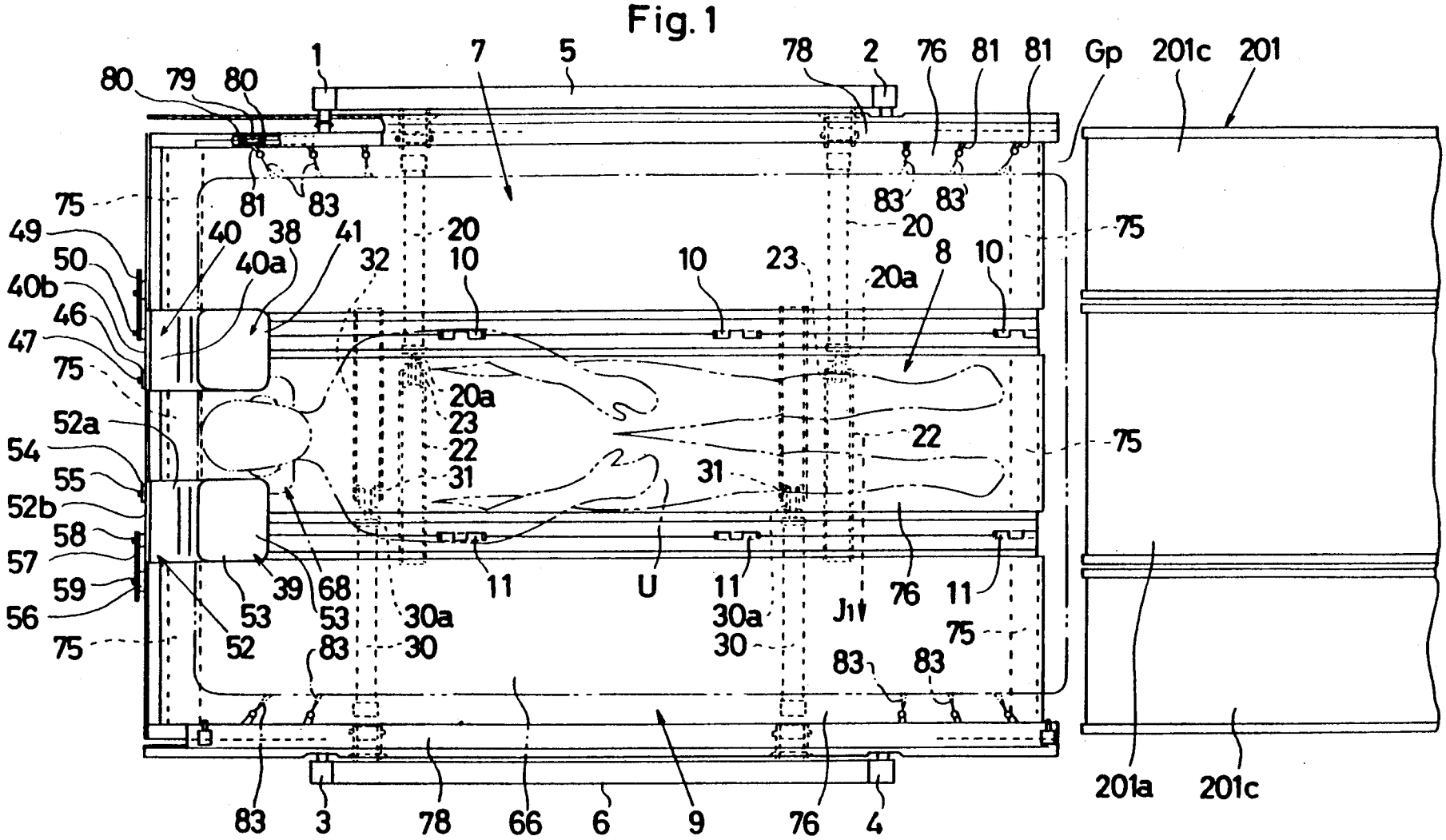
FIG. 1 is a plan view of a system of this invention.
Figure 2:
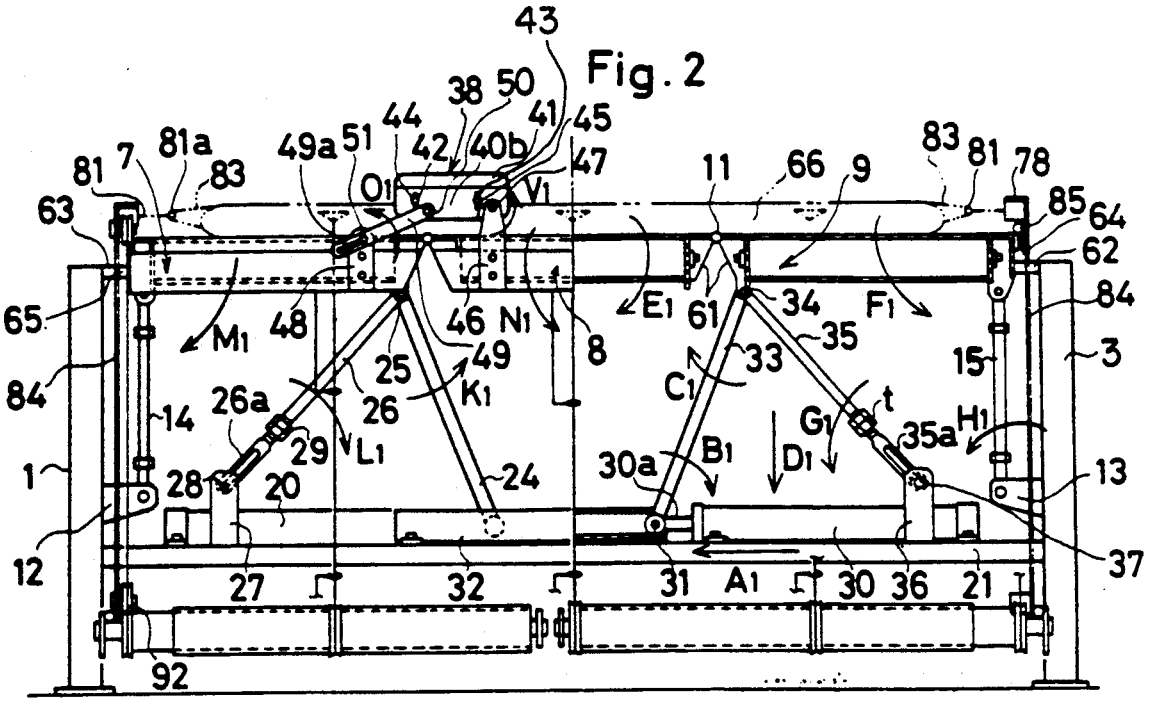
FIG. 2 is a partial cross-sectional end view of a bed body.

Referring to FIGS. 1 and 2, numerals 1 through 4 designate poles disposed to four corners of a rectangular shaped system of this invention. Between the poles 1 and 2, a horizontal beam 5 is extended. In the same manner, another horizontal beam 6 is extended between the poles 3 and 4. Numerals 7 through 9, in turn, designate first through third bed plate pieces which are horizontally arranged on the poles. Those bed plate pieces 7, 8 and 9 are in turn corresponding to left side, back side and right side of a bed-ridden patient U, and connected in series by means of hinges 10 and 11 in usually flat relationship. The bed plate pieces 7 and 8 are adapted to form a V-shaped valley by the action of the hinge 10. In subsequent to this formation, the bed plate pieces 8 and 9 are adapted to form a V-shaped valley by the action of the hinge 11.

Those bed plate pieces comprising rollers 75, 75 and a belt 76 extended between the rollers. Further, a tension roller 75*a* is provided to take off slack from the belt 76.

In the mean time, paired arms 12 and 13 are secured to the beams 5 and 6. Between the paired arms 12 and the first bed plate piece 7, two rods 14 are provided. Each of the rods 14 is pivotally supported at its lower end to the arm 12 by means of a pin and at the upper end to the first bed plate piece 7. Between the paired arms 13 and the third bed plate piece 9, two rods 15 are provided. Each of the rods 15 is pivotally supported at its lower end to the arm 13 by means of a pin and at the upper end to the third bed plate piece 9. Between the rods 15 and 15, upper and lower beams 16 and 17 are extended together with crisscross shaped beams 18 and 19 for reinforcement. Between the rods 14 and 14, upper and lower beams (not shown) are extended together with crisscross shaped beams (not shown) for reinforcement in the same manner mentioned above. On a base plate 21, are two hydraulic cylinders 20 placed in spaced relationship in a manner to correspond to the first bed plate piece 7. The cylinder 20 protracts a rod 20*a* adapted to reciprocally move along a rail trail 22 through a roller 23. Between the first bed plate piece 7 and the hydraulic cylinder 20 a fork-shaped bar 24 is disposed, the lower end of which is pivoted to the roller 23, and the upper end of which is pivoted to the first bed plate piece 7 by means of a pin 25. A support bar 26 is pivoted at its upper end to the pin 25 with an oval-shaped hole 26*a* provided at the lower end. The bar 26 is mounted to move in the lengthwise direction by inserting a pin 28 into the hole 26*a*. The pin 28 is secured to a mounting piece 27 on the base plate 21. The bar 26 is adjusted to be stretched by a turnbuckle 29 when the first bed plate piece 7 is in a horizontal position.

On the base plate 21, two hydraulic cylinders 30 are placed in the same manner as above. The cylinder 30 extends a rod 30*a* adapted to reciprocally move along a rail trail 32 through a roller 31. Between the third bed plate piece 9 and the hydraulic cylinder 30, a fork-shaped bar 33 is disposed, the lower end of which is pivoted to the roller 31, and the upper end of which is pivoted to the third bed plate piece 9 by means of a pin 34. A support bar 35 is pivoted at its upper end to the pin 34 with an oval-shaped hole 35*a* provided at the lower end. The bar 35 is adjustable at its length by means of a turnbuckle (t), and arranged to move in the lengthwise direction by inserting a pin 37 into the hole 35*a*. The pin 37 is secured to a mounting piece 36 on the base plate 21.

Figure 3:
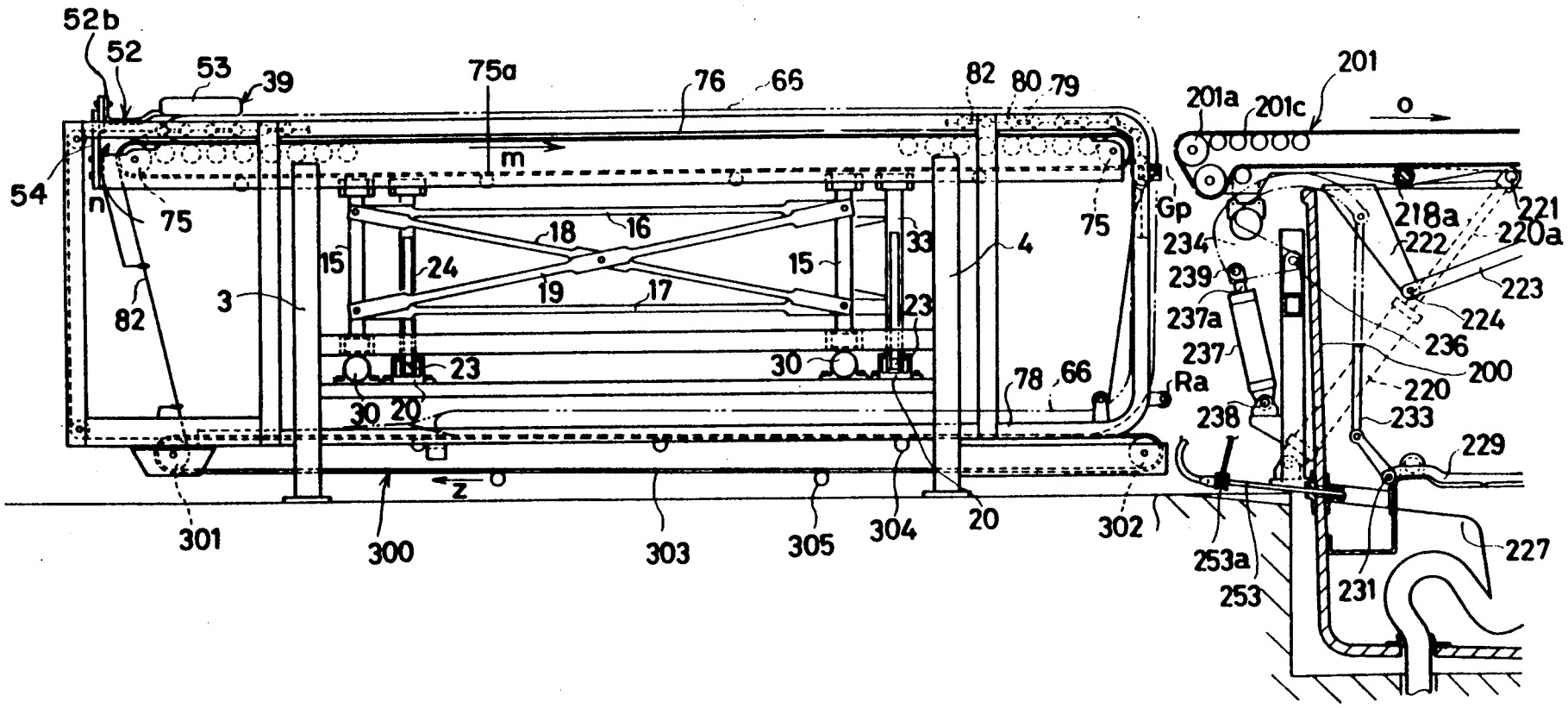
FIG. 3 is a side elevational view of the bed body with a bathtub wherein the bathtub is partially broken away.
Figure 4A:
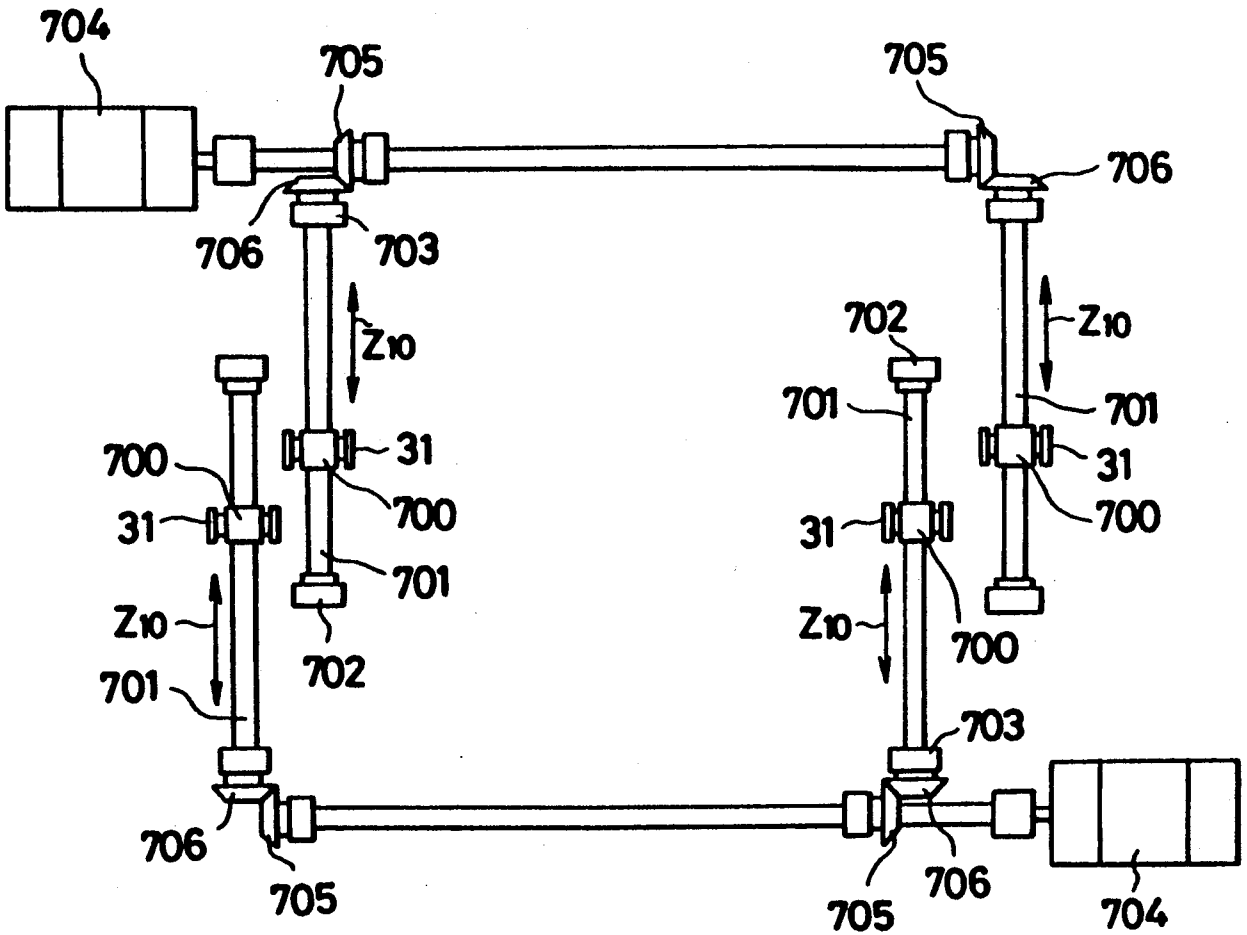
Figure 5:
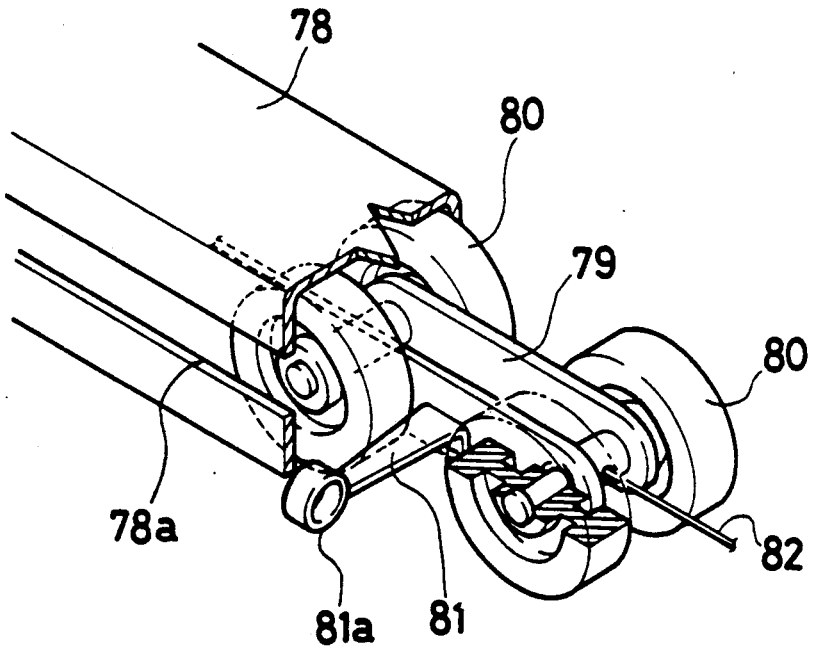
FIG. 5 is a perspective view of peripheral structure of the bed body.
Figure 6:
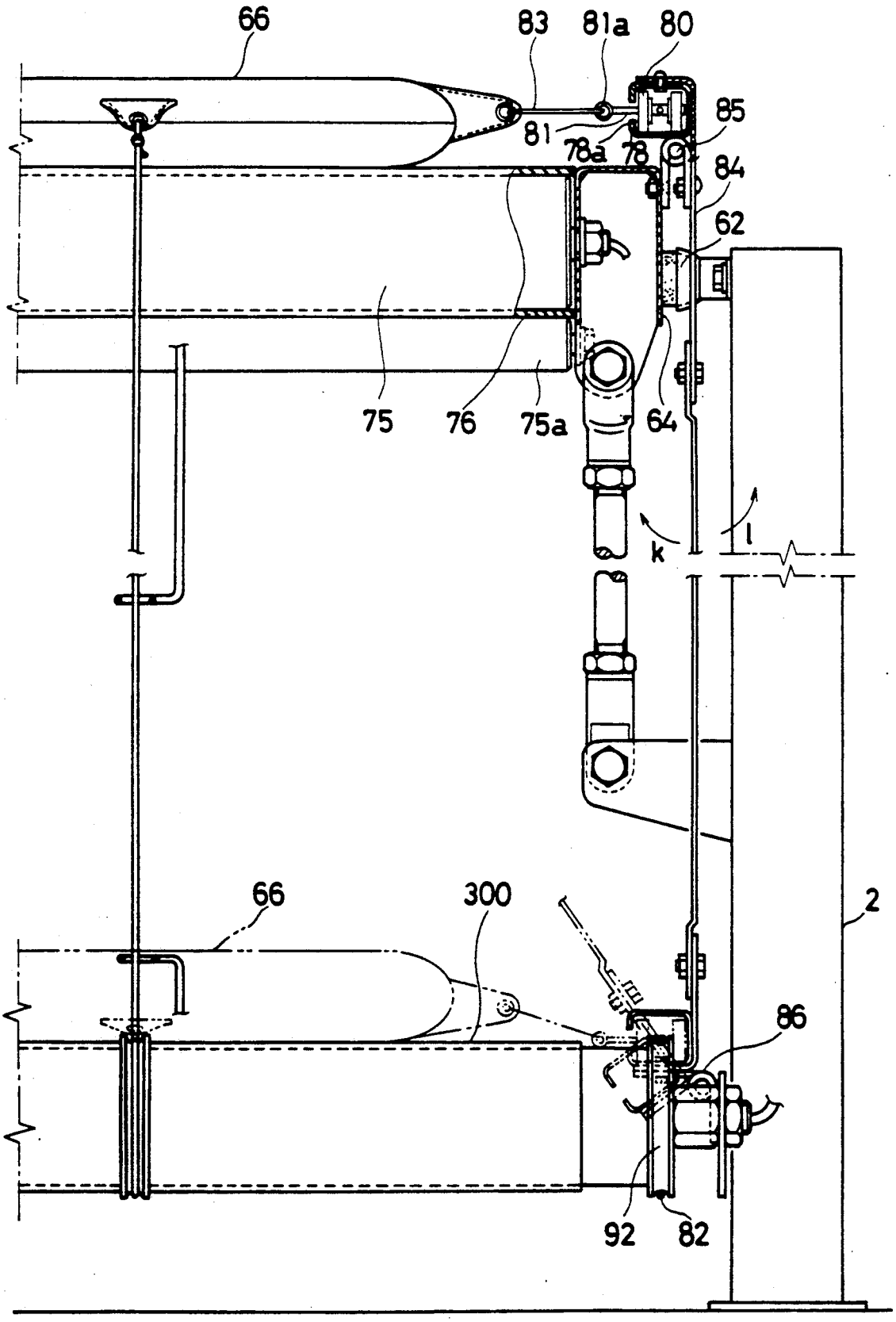
FIG. 6 is a enlarged cross sectional view of how the rollers run along a rail.

On both outside longitudinal sides of the bed plate pieces 7 and 9, a sheath-shaped rail 78 is placed as seen in FIGS. 2, 3 and 5. The rail 78 has a rectangular section and a lengthwise slit 78*a* at its inner side. In this rail 78, a pair of rollers 80, 80 which are fixed by a connector plate 79, are movably disposed therealong. The connector plate 79 has an arm 81 extended outside through the slit 78*a* to form a hook 81*a*. Those paired rollers are connected in series by a wire 82, and disposed in the rail 78 at regular intervals all through the length. Over the bed plate pieces 7, 8 and 9, is placed a mattress 66, the peripheral of which has a number of bands 83 each connected to the hooks 81*a*. An elevation plate 84 is mounted on both sides of the bed body in a manner to be screwed to the rail 78, and at the same time, secured to each side of the first and third bed plate pieces 7, 9. The elevation plate 84 is adapted to oscillate within the predetermined range in two directions as shown by arrows (k) and (l) in FIG. 6. Under the rail 78, is an accommodation space 300 in which rollers 301 and 302 and a belt 303 extended between the rollers are placed as seen in FIG. 3. Into a space between the rail 78 and the belt 303, the mattress 66 is adapted to be accommodated when the patient U is transferred to a bathing tub as described hereinafter. Tension rollers 304 and 305 are provided to take up slack from the belt 303.

Figure 4:
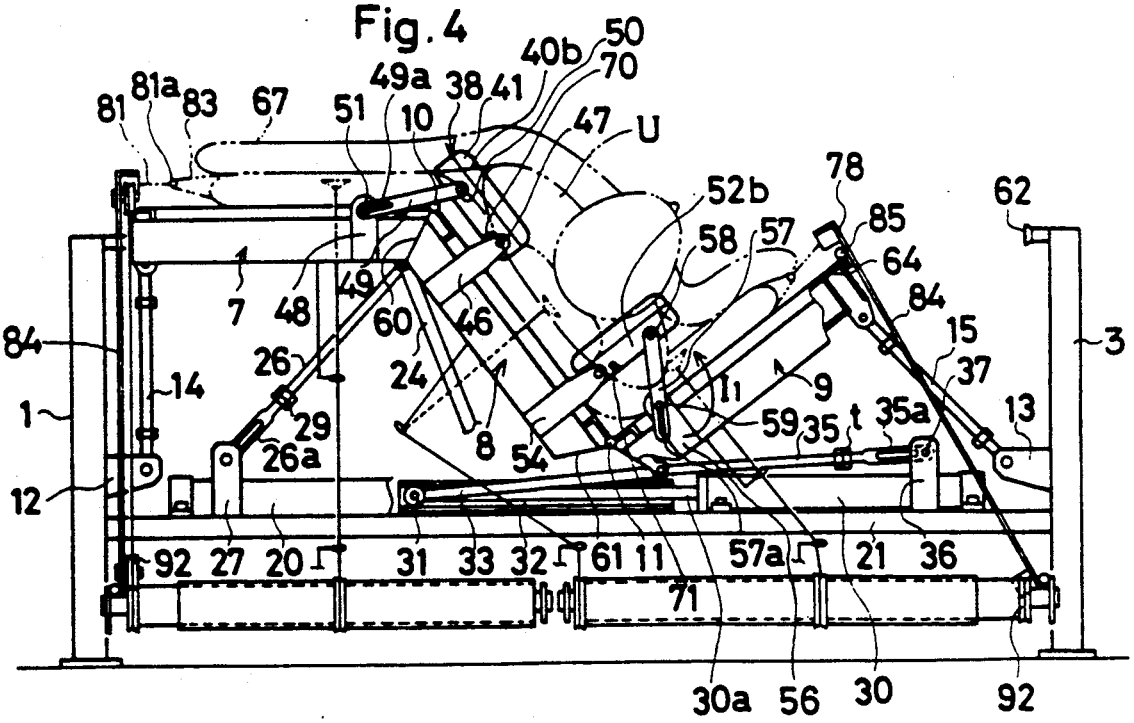
FIG. 4 is an end elevational view of the bed body.

Headrests 38 and 39 are provided. Headrests 38 straddles the first and second bed plate pieces 7 and 8 and headrest 39 straddles the second and third bed plate pieces 8 and 9. The headrest 38 has a L-shaped stay 40 having a head side receiver 41 on a horizontal hand 40*a*. The stay 40 has oblong holes 42 and 43 in a vertical hand 40*b* through which bolts 44 and 45 are secured to the receiver 41. By loosing these bolts, the receiver 41 is adjusted at its height within the length of the oblong holes. At the vertical hand 40*b* of the stay 40, is a stop 70 which engages with an elevation plate 46 to prevent the stay 40 from inadvertently being pivoted in the direction of arrow (V1) from a horizontal position as seen in FIGS. 2 and 4.

The vertical hand 40*b* is pivotally connected at one end to the elevation plate 46 by means of a pin 47, and connected at the other end to an elevation plate 48 by means of a pin 50 through a link 49. The link 49 has an oblong hole 49*a* at its lower end into which a pin 51 is inserted to move along the longer diameter of the hole 49*a*. The pin 51 is mounted on a top of the elevation plate 48.

In so doing, the headrest 39 has a stay 52 having a head side receiver 53 which is adjustable at its height in a same manner as the receiver 41. The stay 52 is pivoted at one end of a vertical hand 52*b* to an elevation plate 54 by means a pin 55. The other end of the stay 52 is pivoted to an elevation plate 56 from the third bed plate piece 9 through a link 57 and a pin 58. The link 57 has an oblong hole 57*a* at its lower end into which a pin 59 is inserted to move along the longer diameter of the hole 57*a*. The pin 59 is mounted on a top of the elevation plate 54. At the vertical hand 52*b* of the stay 52, is a stop 71 which engages with the elevation plate 54 to prevent the stay 52 from inadvertently being pivoted from a horizontal position. Numerals 60 and 61 designate beveled portions which are formed at connecting sides of the bed plate pieces 7, 8 and 8, 9. Numerals 62, 63 designate stops provided at inner sides of the poles 1 and 3 which are adapted to rest on projections 64 and 65 formed at the first and third bed plate pieces 7 and 9.

Figure 7:
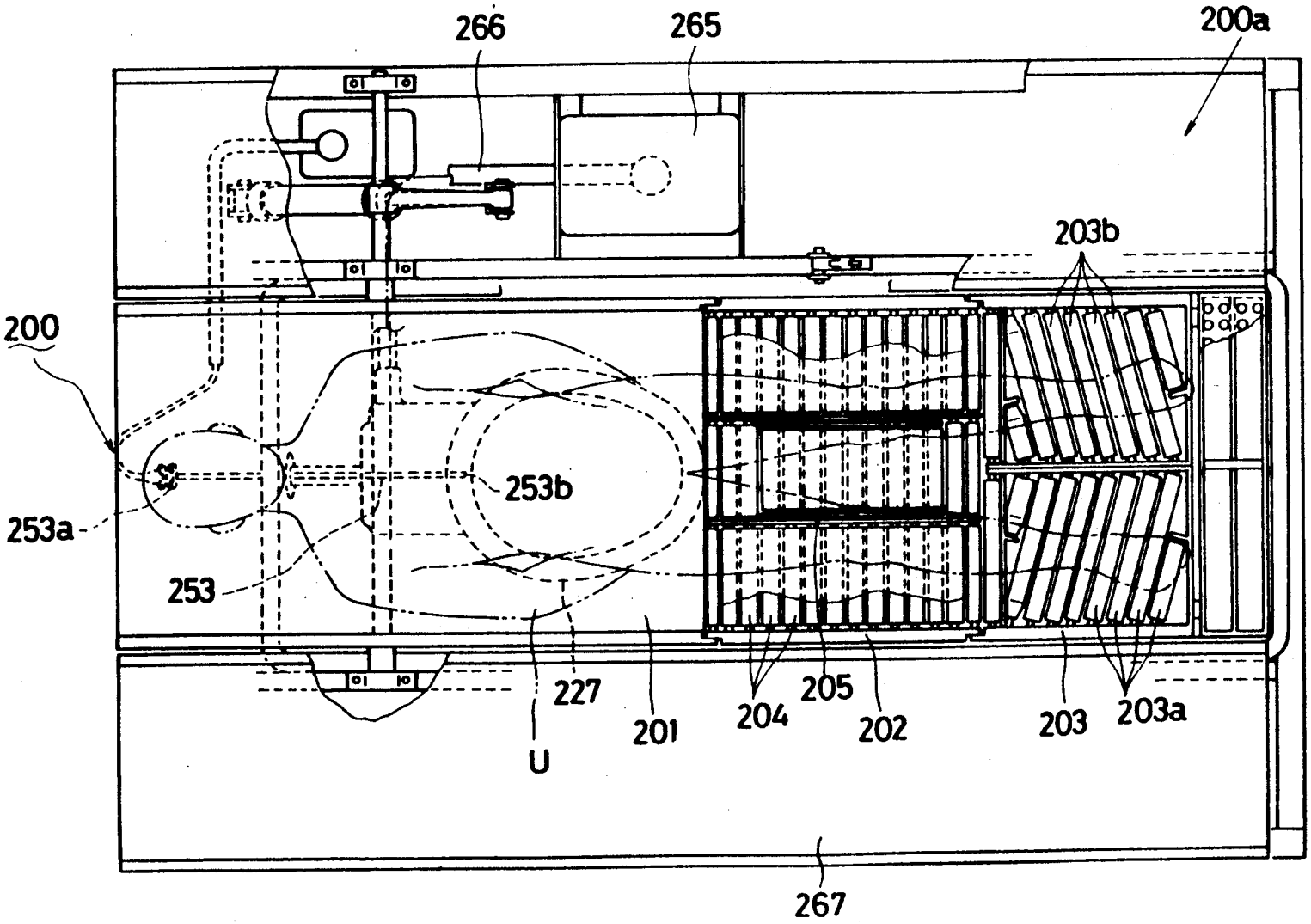
FIG. 7 is a plan view mainly showing a part of a rest plate pieces.
Figure 8:
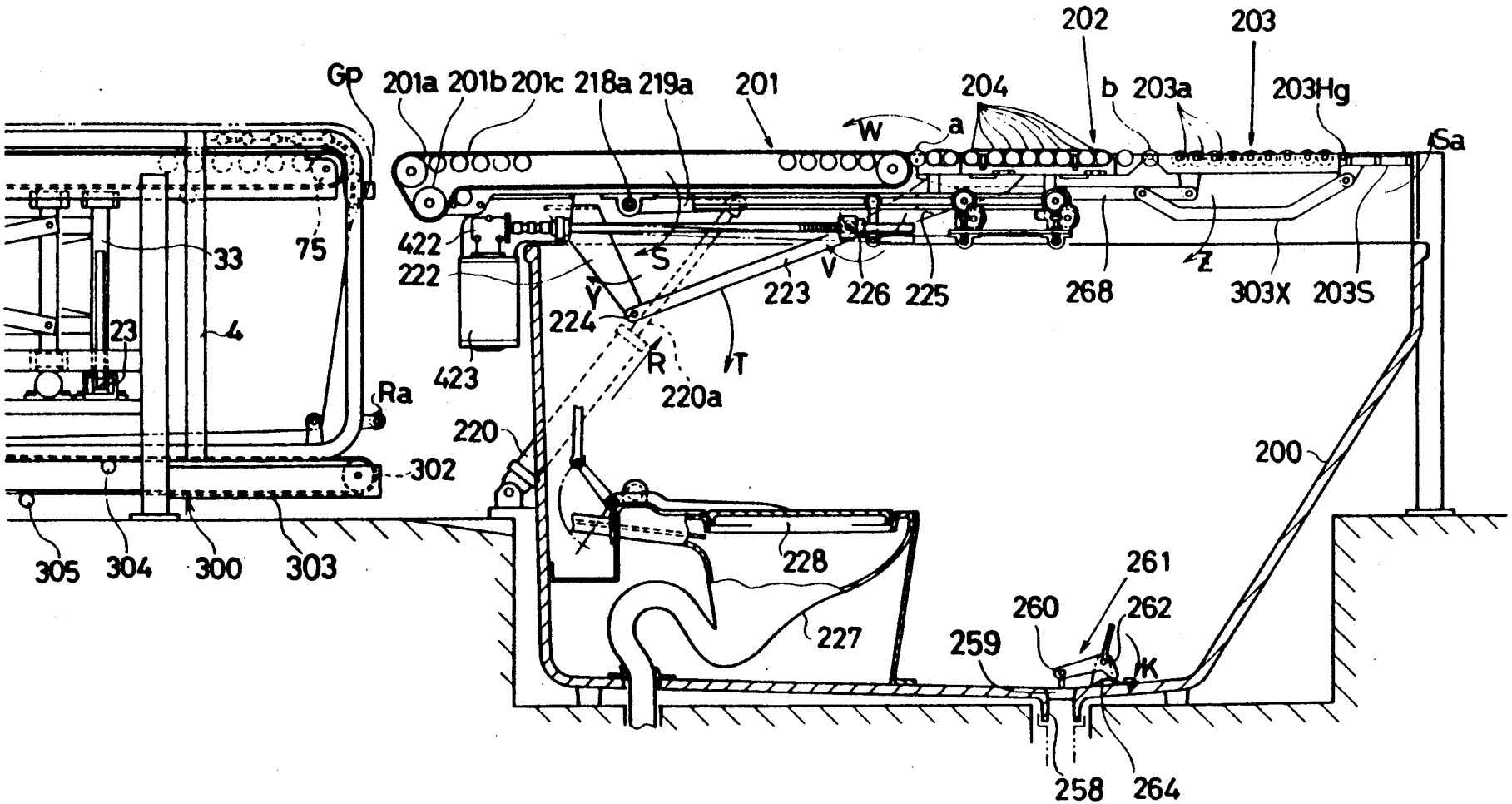
FIG. 8 is a longitudinal cross sectional view of a bathing tub in neighboring relationship with the rest plate pieces.

At the right side of the bed body, the bathing tub 200 is placed with a slight gap (Gp). On an open upper end of the tub 200, is rest plate pieces placed on which the patient U is to lie on his back. The rest plate pieces comprising first, second and third rest plate pieces 201, 202, 203 each connected in series by means of hinges (a), (b) in a manner to in turn correspond to upper half body, hip portion and legs portion of the patient U as seen in FIGS. 7 and 8. The first rest plate piece 201 comprising two rollers 201*a*, 201*b* and a belt 201*c* extended between the rollers 201*a* and 201*b*. The second rest plate piece 202 comprising a row of rollers 204 and a belt extended around the rollers 204 and having an opening 205 corresponding to an upper open end of a toilet bowl described hereinafter. The third rest plate piece 203 comprising two rows of rollers 203*a*, 203*b* which position at the right and left side of the leg portions to cross in a central portion so as to separate the legs when the legs slides on the rollers 203*a* and 203*b*.

Further, the third rest plate piece 203 has a step plate 203S connected by means of a hinge 203Hg. A link 303X is provided to connect between the second rest plate piece 202 and the step plate 203S, the link 303X acts to make the step plate 203S pivot about the hinge 203Hg in the direction of arrow (Sa) of FIG. 8 so that the patient U can rest his feet on the step plate 203S.

A closure means is provided to alternately open and close the opening 205 as seen in FIGS. 9 through 12. A bracket 400 is provided with the second rest plate piece 202 to straddle the opening 205. The bracket 400 has a straight rail 401 which terminates at a semi-circular rail portion. The rail 401 has a guide roller 408 accommodated to move along its lengthwise direction.

Along the rail 401, a semi-circular guide rail 401*a* is provided, so that the guide roller 408 moves along an outer side of the rail 401 with the roller 402 engaging against the rail 401*a* when the closure means displaces from solidlined position to phantom-lined position as described hereinafter.

During process in which the closure means moves from the phantom-lined position to the solid-lined position, the guide roller 408 moves downward along the outer side of the rail 401 with the roller 402 engaging against the inner side of the rail 401*a*. This makes it possible for the closure means to smoothly change from horizontal movement to vertical movement and vice versa. The roller 402 is secured to a shaft 403 for free wheeling which is secured to a vertical link 405 to which a toothed wheel 404 is fixedly secured. The link 405 is pivoted at its upper end to the shaft 403, and adapted to move together with upper and lower connector links 405*a* and 405*b*. The link 405 is secured at its lower end to a horizontal link 406 through a pin 407. At one side of the vertical link 405, the guide roller 408 is supported on a shaft 408*a*. At the other side of the vertical link 405, is a guide shaft 409 projecting horizontally to rotationally support a lift gear 410 which meshes with the toothed wheel 404. A ratchet wheel 411 is supported by the guide shaft 409. The lift gear 410 has a pawl 412 which is always urged to mesh with the ratchet wheel 411 by a spring (Sp) so as to act as a one-way clutch between the lift gear 410 and the ratchet wheel 411. A rectangular plate 413 and cancel plate 414 are provided on the guide shaft 409 to rotate in unison with the ratchet wheel 411. A leaf spring 415 has upper and lower wings which sandwich the ratchet wheel 411 to regulate the rotational movement of the ratchet wheel 411.

Horizontal link 406 has its tail end connected to a vertical link 416 by means of a pin 417. The vertical link 416 connects at its upper end to a roller 418 located at the rail 401, and has a horizontal lancer 419. The lancer 419 has a tubular portion 420, the inner side of which has a female thread. A bar 421 has a male thread at its outer surface which is connected to the tubular portion 420, and adapted to be driven by an electric motor 423 through a reducer 422. With energization of the motor 423 the bar 421 rotates to move the tubular portion 420 in the direction of arrow ($\beta$) in FIG. 9. The horizontal link 406, which acts as a carrier, has a square plate 425 secured thereto by bolts, and four corners of which have a stud 426 having a permanent magnet 427 on its top end.

Figure 11:
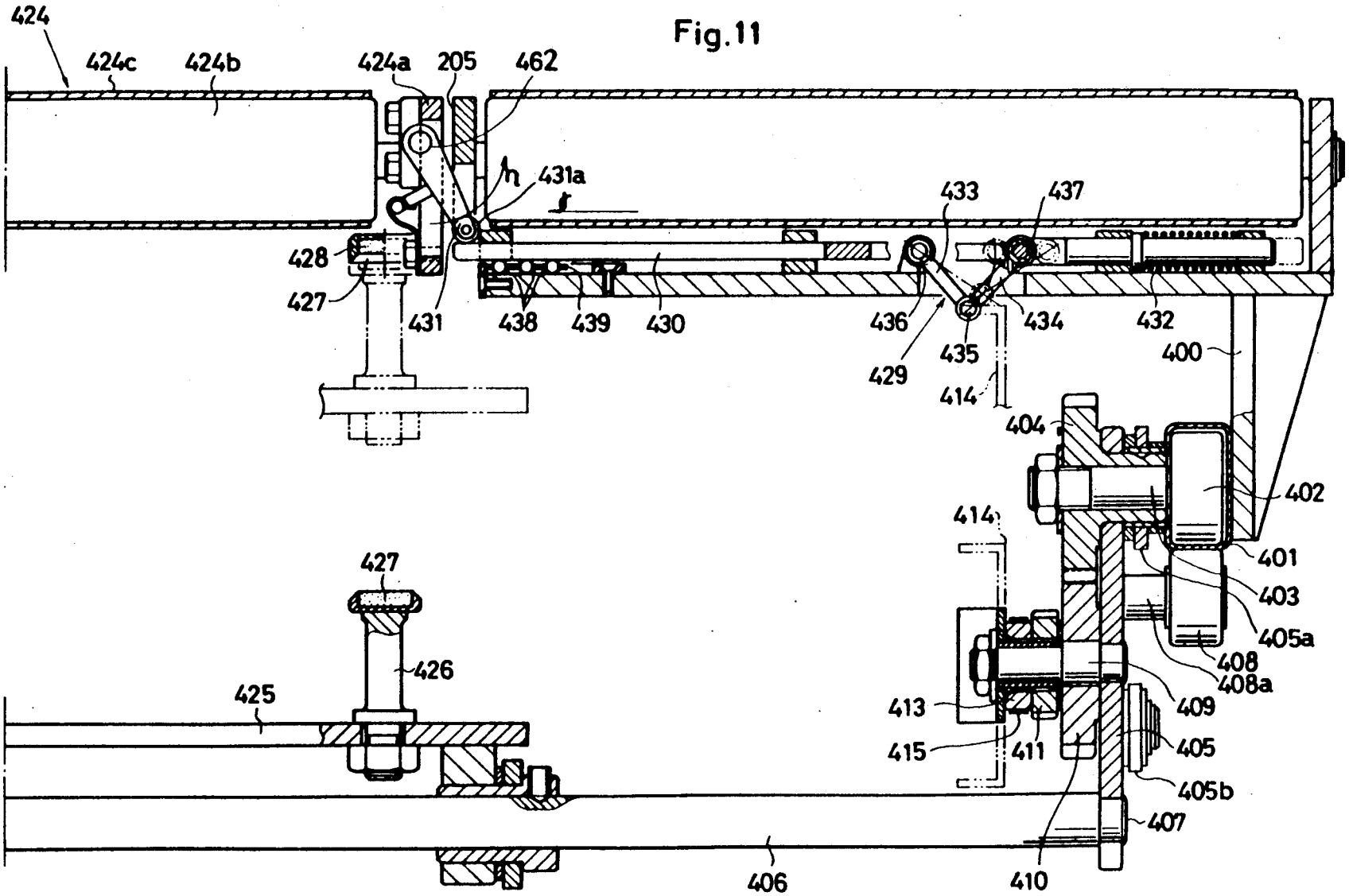
Figure 12:
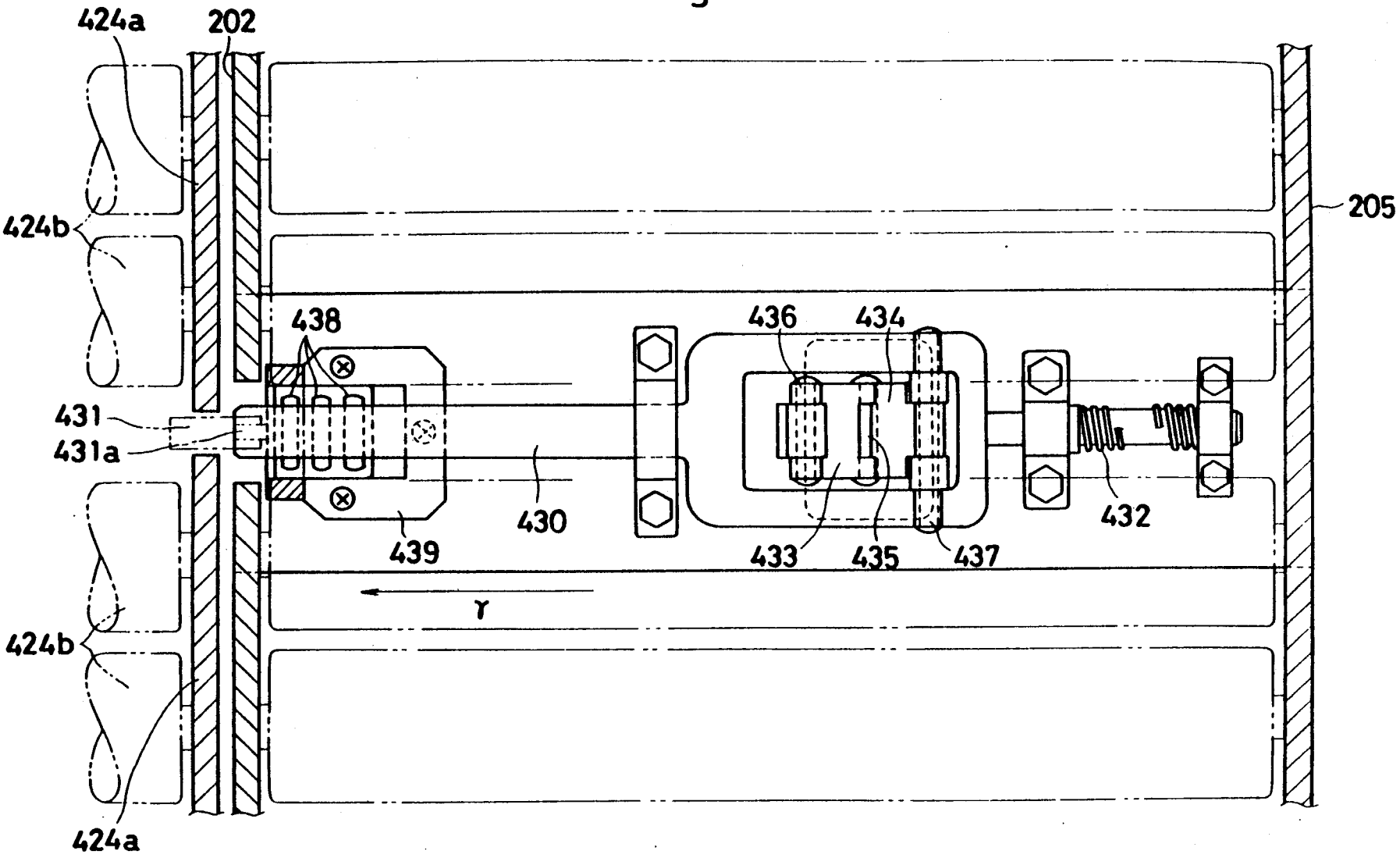

The closure means has a lid 424 in addition to the carrier. The lid 424 comprising a frame 424*a*, rollers 424*b* and a belt 424*c* extended around the rollers 424*b*. The lid 424 has a permanent magnet 428 at its four corners to correspond to the magnet 427. The lid 424 is usually held to close the opening 205 by latch means 429 which has a latch bar 430 placed at the second rest plate piece 202 as seen in FIGS. 11 and 12. The latch bar 430 is adapted to move in the direction and counter direction of arrow ($\gamma$), and always urged by a coil spring 432 in the direction of arrow ($\gamma$), so that the latch bar 430 engages its one end with a bar 431 through a roller 431*a*. The bar 431 is lockably mounted on the frame 424*a* by means of a pin 462 to oscillate within the predetermined angle, and usually urged by a spring in the direction of arrow ($\eta$) to engage the latch bar 430. Two links 433 and 434 are connected by a pin 435 to form a V-shaped configuration. The link 433 is connected at its upper end to the second rest plate piece 202 by means of a pin 436, while the link 434 is connected at its upper end to the latch bar 430 through a pin 437. The latch bar 430 usually engages its one end with a lower end of the bar 431 through the roller 431*a* to hold the lid 424 in place. As described hereinafter, the two links 433 and 434 expand to lie flat when the cancel plate 414 moves upward to engage with the pin 435 so as to push it upward. With this upward movement, the latch bar 430 moves against the force of the spring 423 in the direction opposite to arrow ($\gamma$) to disengage the bar 431 from the roller 431*a* for retracting from the opening 205. Then, the lid 424 is released from latched position.

When the cancel plate 414 moves downward to separate from the pin 435, the links 434 and 433 are compressed by the spring 432 to form the original V-shaped configuration, thus moving the latch bar 430 in the direction of arrow ($\gamma$). Numeral 438 designates a pin roller rotationally mounted on a plate 439 to allow for smooth movement of the latch bar 430. Upon revealing the opening 205, the motor 423 is energized to rotate the bar 421 in one direction. From the fact that the bar 421 mates its male thread with the female thread of the tubular portion 420, the portion 420 moves together with the vertical, horizontal links 416, 406 and the carrier from the solid position of FIG. 9 to the phantom lined position with the assist of the rollers 418, 402 and the rail 401. With this movement of the carrier, the magnets 427 and 428 face each other in the vertical relationship, then the lift gear 410 moves around the toothed wheel 404 in the direction of arrow ($\alpha$) by an angle of approximately 90 degrees as seen in FIG. 10. In consequence, the carrier moves upward from the solid-lined position to the phantom lined position, so that the magnet 427 engages the magnet 428. In this instance, the cancel plate 414 is positioned at the phantom line of FIG. 10 to push up the pin 435 as seen in FIG. 11. The expanded links 433 and 434 cause the latch bar 430 to move in the direction opposite to arrow ($\gamma$) to release the latch bar 430 from the bar 431. With the release of the latch bar 430, the bar 421 rotates in the other direction to move the tubular portion 420 together with the links 416 and 406 in the direction opposite to arrow ($\beta$). With this movement, the lift gear 410 moves around the toothed wheel 404 in the direction opposite to arrow ($\alpha$) so as to return to the original solid-lined position with rotation of the plates 414 and 413 prohibited by the action of the pawl 412. Each time when the lift gear 410 moves to the solid-lined position, the plate 413 intermittently rotates by an angle of 90 degrees together with the cancel plate 414. With the downward movement of the carrier, the square plate 425 descends with the lid 424 in unison to the solid-lined position so as to reveal the opening 205 from the reason that the magnets 427 and 428 engage each other.

In this instance, the cancel plate 414 moves downward to release the pin 435 so as to return the latch bar 430 to the original position by the coil spring 432. The closure means having the carrier and the lid 424, moves back to the original solid-lined position, and at the same time the motor 423 is deenergized.

To close the opening 205, the motor 423 is energized to move the closure means from the solid-lined position of FIG. 10 to the phantom-lined position of FIG. 10 to locate it at the space of the opening 205.

With the entry of the closure means into the opening 205, the bar 431 temporarily oscillates in the direction opposite to arrow ($\eta$) so as to allow the engagement of the roller 431*a* for holding the lid 424 in place. Then, the carrier alone moves downward to the original solid-lined position with the lid 424 left at the opening 205 due to the fact that the magnetic attraction between the magnets 427 and 428 in forcibly overcome. In so doing, the carrier moves in the direction opposite to arrow ($\beta$) with the lid 424 left at the opening 205 so as to return the original solid-lined position, and then the motor 423 is deenergized.

The construction is such that the carrier slides along the rest plate piece to make a whole structure relatively simple, in opposition to that a lid moves detachably in the direction perpendicular to a rest plate piece.

It is appreciated that a microswitch may be disposed to on-off actuate the motor in association with the movement of the carrier. Instead of the microswitch, other switches such as a limit switch and a proximity switch may be used.

Figure 14:
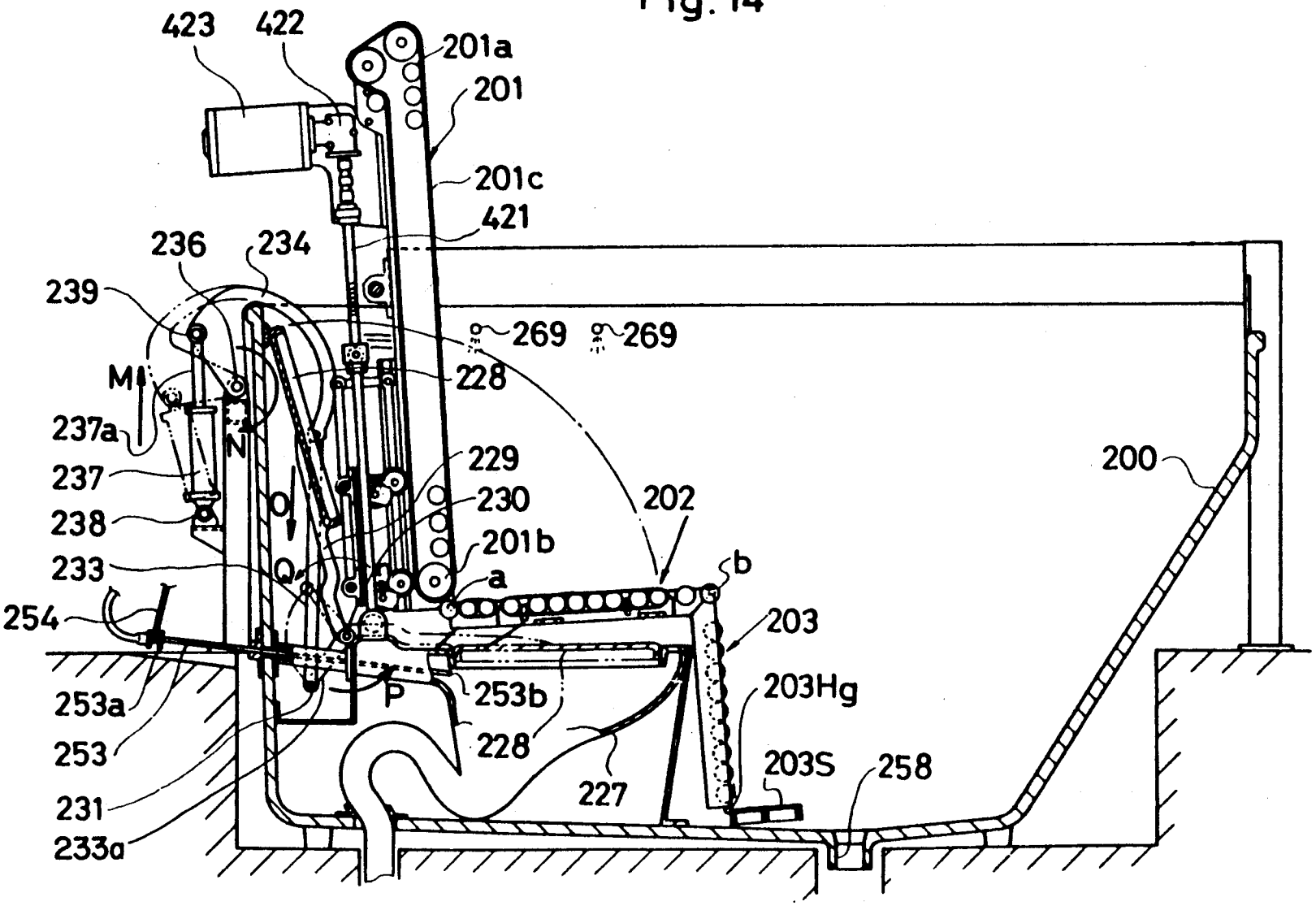
FIGS. 14 and 15 are longitudinal cross sectional views showing how the rest plate pieces works.

Attention is directed to FIG. 8, in which an arm 219*a* is connected at one end to the first rest plate piece 201, and at other end to a rod 220*a* of a hydraulic cylinder 220 by means of a pivot pin 221. A bracket 222 is fixed at an upper end to the first rest plate piece 201, and projected at a lower end into the bathing tub 200. A link 223 is connected at one end to the lower end by means of a pivot pin 224, and at the other end to the second rest plate piece 202 by way of a link 225 and a pin 226. At an inner bottom of the tub 200, is a toilet bowl 227 placed in position below the first rest plate piece 201. As seen in FIG. 14, the bowl 227 has an oval-shaped lid plate 228 hinged to an upper open end of the bowl 227. The lid plate 228 is adapted to form a liquid-tight seal when the plate 228 moves down about a hinge pin 230 to close the upper opening by means of a rubber gasket (not shown). Between the pin 230 and an upper side of the lid plate 228, is a bifurcated hand 229 integrally provided. Short link 233*a* is fixed to one end of pin 230 and the other end is pivotably connected to one end of link 233 by pin 231. Movement of link 233 in the direction of arrow (O) caused short link 233*a* to pivot from position of phantom line to position of solid line so as to turn lid plate 228 in the direction of arrow Q as shown in FIG. 14.

Figure 15:
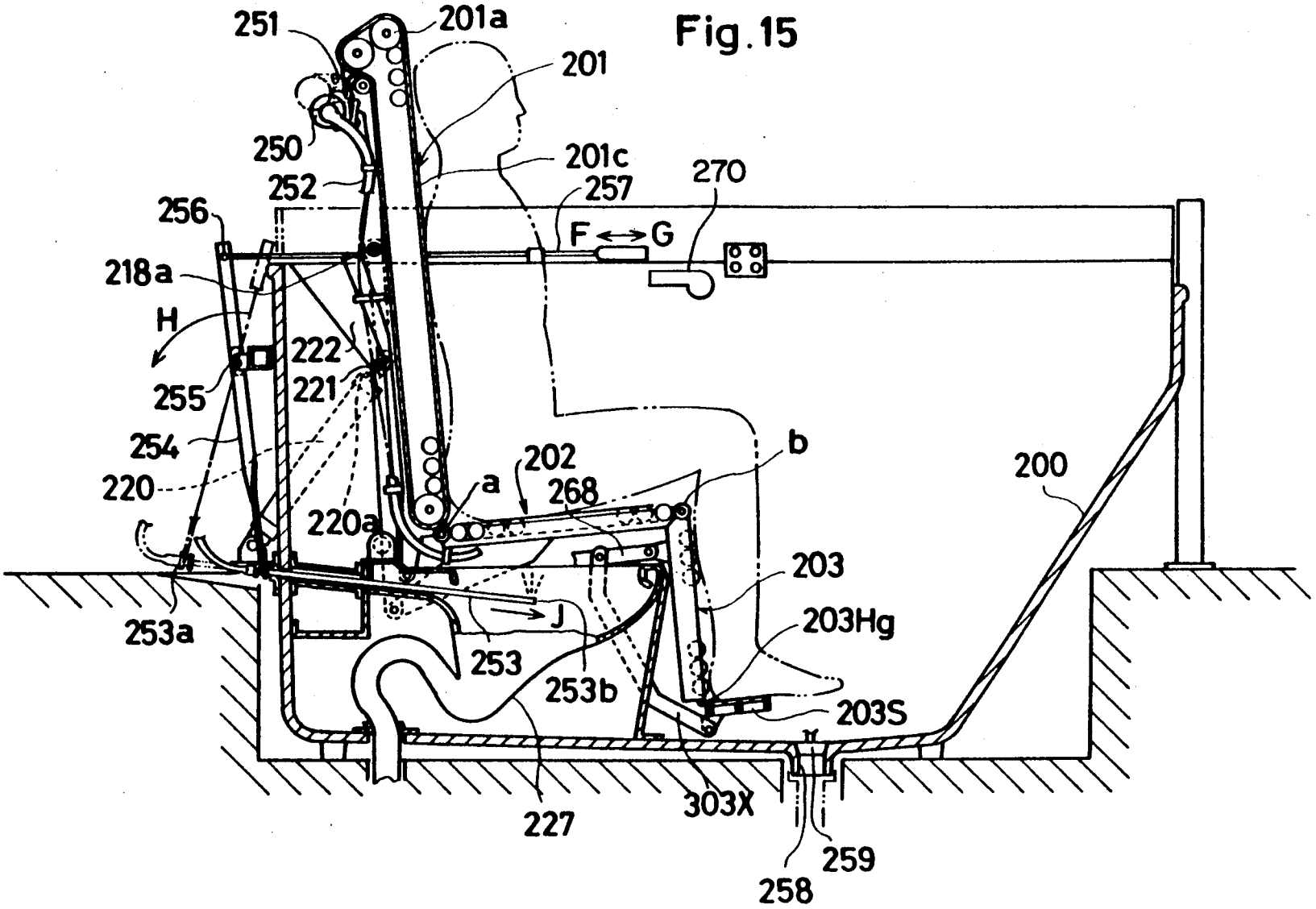

A hydraulic cylinder 237 is connected at its lower end to the outer side of the tub 200 means of a pin 238, and having a protractable rod 237*a*, upper end of which is hinged to the semi-circular link 234 through a pin 239. As seen in FIG. 15, a warm-air generator 250 is provided on the back side of the first rest plate piece 201 through two pairs of links 251. Each of the paired links is hinged at both ends, so that the generator 250 displaces from the solid-lined position to the phantom-lined position under the influence of gravity when the rest plate piece 201 changes from solid-lined horizontal position to phantom-lined vertical position.

With the downward displacement of the warm-air generator 250, slack is provided in a feed-pipe 252 to absorb tension caused from the rest plate pieces 201 and 202 being bent around the hinge (a).

When the rest plate pieces move to form a chair-shaped configuration as a whole within the tub 200, a leading end of the pipe 252 is positioned upwardly toward the bottom of the patient U through the opening 205 as seen in FIG. 15.

An injection pipe 253, which provides a warm water after bowel movement for rising, is disposed to move in a lengthwise direction. The pipe 253 has a hinged portion 253*a* at one end which projects outside the tub 200. The other end of the pipe 253 terminates at the inner side of the toilet bowl 227. A vertical lever 254 is provided to rotate about its central portion in a vertical plane. The vertical lever 254 has a fork portion at its lower end which clutches the hinged portion 253*a* of the pipe 253. The upper end of the vertical lever 254 is hinged to a horizontal lever 257 by means of a pin 256. The horizontal lever 257 is adapted to move in dual directions of double headed arrow (F) and (G) as seen in FIG. 15.

With the movement of the horizontal lever 257 in the direction of arrow (F), the vertical lever 254 rotates about a pin 255 in the direction of arrow (H) to move the injection pipe 253 in the direction of arrow (J). The lever 253 moved in the direction of arrow (G), causes the vertical lever 254 to rotate about the pin 255 in the direction opposite to arrow (H) to occupy the phantom-lined position, and moving the injection pipe 253 by way of the hinged portion 253*a* in the direction opposite to arrow (J).

In this way, the injection pipe 253 is adjusted in its horizontal position, thus enabling to change the location of an outlet 253*b* of the pipe 253.

Figure 13:
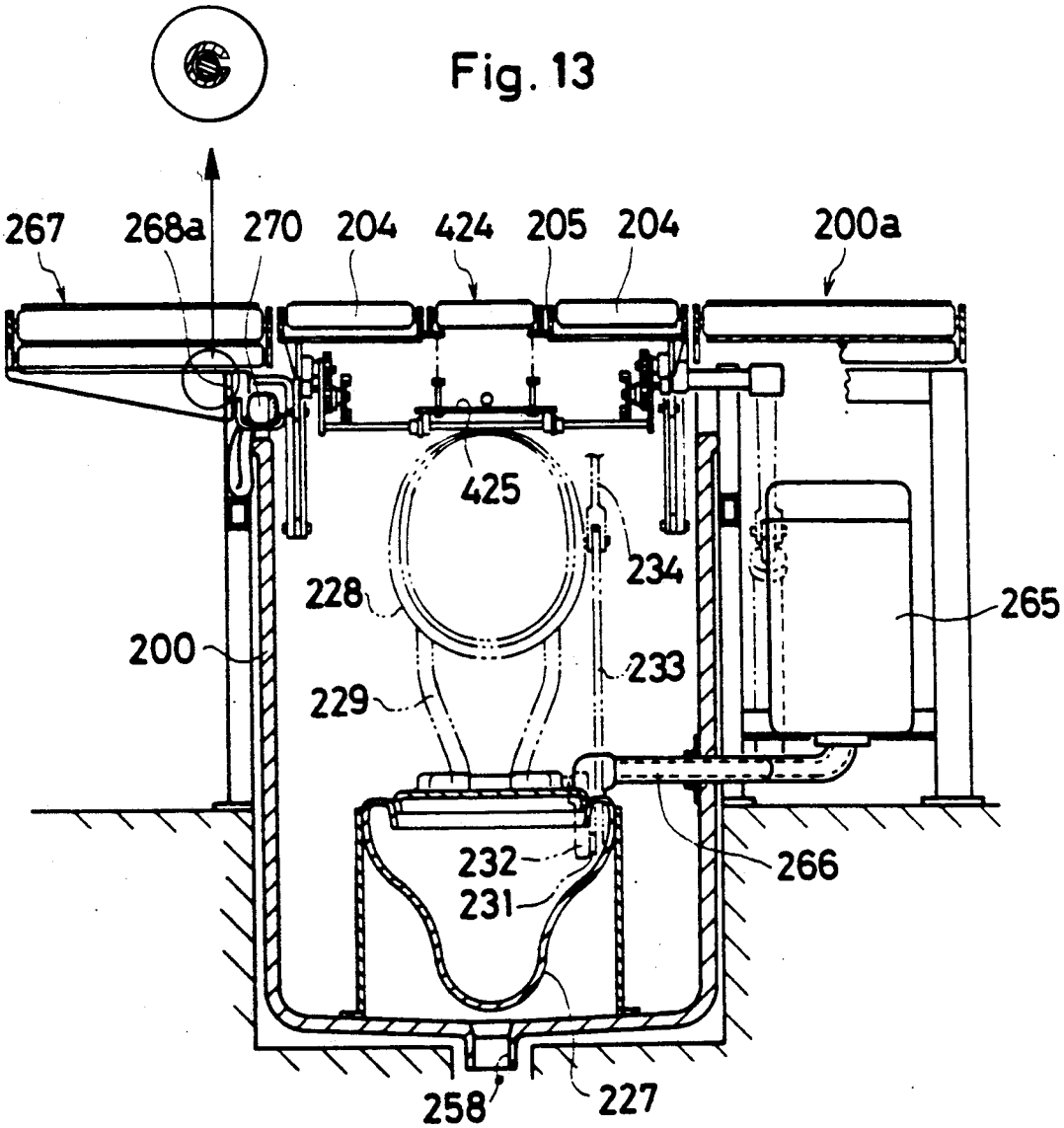
FIG. 13 is a cross sectional view of a toilet bowl depicted with a bathing tub.

At the inner bottom of the tub 200, is a inversed-cone shaped drain opening 258 provided into which a plug 259 is fit as seen in FIG. 8. The plug 259 has a central stud 260 to which one finger of a bifurcated lever 261 is secured by means of a pin 262. The lever 261 is lockable around the pin 262, and engaged at other finger with upper surface of an arched leaf spring 264. After soaking into a warm water in the tub 200, the lever 261 is rotated around the pin 262 in the direction of arrow (K) so as to move the plug 259 upward to reveal the drain opening 258, thus enabling to release the warm water outside. The lever 261 rotated in the direction opposite to arrow (K), causes the plug 259 to fit into the drain opening 258 for closure. The rotational operation may be performed by a foot of the patient U. Numeral 265 of FIG. 13 designates a flush water storage tank, which has a pipe 266 communicated with the toilet bowl 227. On both longitudinal sides of the rest plate pieces, are flat aprons 267, 200*a* mounted by means of a hinge 268*a* to be pivoted between horizontal position and vertical position. The apron 267, if located at the vertical position, provide an attendant with easy access to the patient U.

The aprons 267 and 200*a* each comprise rollers and a belt extended between the rollers 204.

In operation of the bed plate means, at the mattress 66 on the second bed plate piece 8, the patient U lies on his back with his head resting on a headrest 68 as seen in FIG. 1.

Upon desiring to turn over on the bed, the hydraulic cylinder 30 is actuated to protract the rod 30*a* in the direction of arrow (A1) in FIG. 2. Then, the roller 31 slides along the rail trail 32 all the way to its extremity, thus causing the bar 33 to move in the direction of arrow (C1), while rotating around the roller 31 in the direction of arrow (B1). The bar 33 is rotated upward at its upper end around the pin 34 in the direction of arrow (C1), while descending in the direction arrow (D1). With the descending movement of the bar 33, the second bed plate piece 8 rotates around the hinge 10 in the direction of arrow (E1), the third bed plate piece 9 rotating in the direction of arrow (F1) due to the rod 15. As a result, the second and third bed plate pieces 8 and 9 tilt around the hinge 11 by an angle of approximately 90 degrees to form a V-shaped valley as seen in FIG. 2. With this tilting formation, the projection 64 disengages from the stop 62, while the support bar 35 is rotated about the pin 37 in the direction of arrow (G1) to generally align with the bar 35, causing the rod 15 to rotate about the arm 13 in the direction of arrow (H1) to occupy a slantwise position. In this instance, the second bed plate piece 8 displaces to slantwise position, so that the patient U changes from the position lying on his back to a position of lying on his right side.

With the change of the bed plate pieces 8 and 9 into V-shaped valley, the elevation plate 54 of the headrest 39 becomes slantwise, and the link 57 rotates in the direction of arrow (I1) in FIG. 4, so that the stay 52 pivots together with the receiver 53 to move in parallel with the third bed plate piece 9. Thus allowing for the patient U to put his side head on the headrest 39 with his back head on the headrest 68.

On the other hand, the hydraulic cylinder 30, when actuated to retract the rod 30*a* in the direction opposite to arrow (A1), makes the roller 31 move to rotate the bar 33 in the direction opposite to arrow (B1), and rising to return to the original position. With this movement, the second and third bed plate pieces 8 and 9 in turn rotates in the directions opposite to arrows (E1) and (F1) to return to the original horizontal position. The link 57 pivots in the direction opposite to arrow (I1), so that the receiver 53 moves together with the stay 52 to return to the original horizontal position with the back head supported on the headrest 68.

Further, the actuated hydraulic cylinder 20 makes the bar 24 in the direction of arrow (J1) of FIG. 1 in unison with the roller 23. This causes the bar 24 to pivot about the pin 25 in the direction of arrow (K1) of FIG. 2 so that the support bar 26 pivots about the pin 28 in the direction of arrow (L1) to align with the bar 24. With this alignment, the first bed plate piece 7 rotates in the direction of arrow (M1), while the second bed plate piece 8 rotates about the hinge 11 in the direction arrow (N1) to form a V-shaped valley with the first and second bed plate pieces 7 and 8 which bend downward to form an angle of approximately 90 degrees at a portion of the hinge 10.

In this instance, the patient U changes from the position lying on his back to a position of lying on his side. With the movement of changing the position, although the side plate 84 moves in the direction of arrow (k) of FIG. 6 by hinges 85 and 86 to occupy slantwise position, the roller 301 and a pulley 92 remain their positions unchanged so as to tightly hold the wire 82 as ever.

With the change of the bed plate pieces 7 and 8 into V-shaped valley the elevation plate 46 of the headrest 38 becomes slantwise, and the link 49 rotates about the pin 51 in the direction of arrow (O1) in FIG. 2, so that the stay 40 pivots together with the receiver 41 to move in parallel with the first bed plate piece 7. This allows for the patient U to put his side head on the headrest 38 with his back head on the headrest 68.

Further, the hydraulic cylinder 20 is actuated to move the rod 20*a* in the direction opposite to arrow (J1) so as to rotate the bar 24 in the direction opposite to arrow (K1). This causes the top end of the bar 24 to descend to rotate the first and second bed plate pieces 7 and 8 about the pin 25 in the directions opposite to arrows (M1) and (N1), returning from the V-shaped valley position to the original horizontal position. The support bar 26 rotates in the direction opposite to arrow (L1) to return to the original slantwise position. At this time, the patient U changes the position to return from lying on his left side to lying on his back at the second bed plate piece 8.

In the headrest 38, the elevation plate 46 returns from the slantwise position to the original vertical position so as to rotate the link 49 in the direction opposite to arrow (O1), making the stay 40 return to the original horizontal position in unison with the receiver 41. This allows for the patient U to move his head from the headrest 38 to put his head on the headrest 68.

With the structure described above, the bed plate pieces 7, 8 and 8, 9 alternately change into V-shaped configuration, so that the patient U can change his lying position for turning over, protecting him against bedsore. As seen in FIG. 3, the mattress 66 and a coverlet 67 favorably follows the V-shaped change of the bed plate pieces, thus preventing the mattress 66 and the coverlet 67 from being out of place so as to sufficiently maintain each function.

It is noted that instead of the hydraulic cylinder 20, a ring and a rod can be used.

The displacement of the ring is transmitted in a manner to rotate the bed plate pieces. Alternatively, the displacement of the rod is transmitted in a manner to rotate the bed plate pieces when the ring is secured to a stationary member.

In the meanwhile, the rollers 201*a* and 201*b* rotate in one direction to move the belt 201*c* in the direction of arrow (o) of FIG. 3 at the first rest plate piece 201 in the tub 200 upon transferring the patient U from the bed body to the rest plate pieces. At the bed body, the rollers 75, 301, 302 and 201*a* are actuated to rotate so that the roller 80 runs along the rail 78 in the direction of arrow (m) of FIG. 3 to move the belt 76.

Due to the fact that the mattress 66 is tensioned by way of the band 83, in addition to the movement of the belt 76, the patient U is moved in the direction of arrow (m) with the coverlet 67 to pass the gap (Gp), and carried to the rest plate piece through the first rest plate piece 201 to position as seen in FIG. 7.

On the other hand, the mattress 66 moves its leading end down through the gap (Gp) by traction of the band 83 to which the roller 80 is connected, and running along the rail 78 as seen at the phantom-lined position in FIG. 3. With the movement of the belt 303 in the direction of arrow (z), the leading end of the mattress 66 rides on the belt 303 through a guide roller (Ra) to be accommodated under the bed body. Then, the rollers 75, 301 and 302 stop each rotational movement, and the patient U is in the state of lying on his back at the rest plate pieces 201, 202 and 203 with the coverlet 67 placed thereon.

In so doing, the opening 205 is revealed upon desiring for the bowel movement. The motor 423 is energized to rotate the bar 421 so as to move the carrier of the closure means with the links 416 and 406 from the solid-lined position of FIG. 9 to the phantom-lined position of FIG. 10. Then, the lift gear 410 moves around the toothed wheel 404 in the direction of arrow (d) so that the carrier moves upward to the phantom-lined position of FIG. 10 to make the magnets 427 and 428 stick each other.

With this movement, the cancel plate 414 displaces to the phantom-lined position of FIG. 10 to move the pin 435 upward. The links 433 and 434 expand each other to move the latch bar 430 in the direction opposite to arrow ($\gamma$) so as to disengage from the oscillable bar 431.

In this situation, the bar 421 is rotated in the reverse direction to move the carrier down in the direction opposite to arrow ($\beta$) to occupy the original solid-lined position due to the fact that the lift gear 410 moves down around the toothed wheel 404 with its rotation permitted by the pawl 412. With the downward movement of the carrier, the lid 424 moves downward from the opening 205 because the lid 424 sticks the square plate 425 by way of the magnets 427 and 428.

In this situation, the hydraulic cylinder 237 is actuated to protract its rods 237*a* in the direction of arrow (M) of FIG. 14 to move the semi-circular link 234 about the pin 236 in the direction of arrow (N). This causes the link 233 to move in the direction of arrow (O), and pivoting the link 232 about the pin 230 in the direction of arrow (P), The oval-shaped lid plate 228 moves upward about the hinge pin to reveal the upper opening of the toilet bowl 227 as seen at the soild-lined position. Then, the hydraulic cylinder 220 of FIG. 8 is actuated to move the rod 220*a* in the direction opposite to arrow (R) so that the arm 219*a* undergoes the counterclockwise rotation to change the first rest plate piece 201 in the direction arrow (S) into the solid-lined vertical position. In accompany with this action, the link 223 pivots about the pin 224 in the direction of arrow (T), at the same time, pivoting the link 225 about the pin 226 in the direction of arrow (V) to move the second rest plate piece 202 downward which pivots about the hinge (a) in the direction of arrow (W) to position directly above the toilet bowl 227 so as to make the opening 205 communicate with the upper opening of the bowl 227 as seen in FIG. 14. Further, a link 268 moves in the direction of arrow (Y) to pivot the third rest plate piece 203 about the hinge (b) in the direction of arrow (Z) to occupy a generally vertical position, thus forming a chair-shaped configuration with the first and second rest plate pieces 201, 202 as a whole. With the movement of the rest plate pieces into the chair-shaped configuration, the patient U is lowered into the interior of trhe tub 200 with bottom portion of the patient situated at the opening 205. After the end of the bowel movement, the injection pipe 253 injects the warm water flow to the bottom portion through the opening 205 for rinsing. Then, the generator 250 is energized to supply the warm air to the underside of the patient for drying.

In so doing, the hudraulic cylinder 220 is actuated to protract the rod 220*a* to pivot the arm 219*a* in the direction opposite to arrow (S), thus pivoting the first rest plate piece 201 about a pin 218*a* in the direction opposite to arrow (S) to return to the original position. With this movement, the link 223 pivots about the pin 224 in the direction opposite to arrow (T), while the link 225 pivots about the pin 226 in the direction opposite to arrow (V) so as to pivot the second rest plate piece 202 about the hinge (a) in the direction opposite to arrow (W), returning to be in flush with the first rest plate piece 202. In accompany with this movement, the link 268 pivot in the direction opposite to arrow (Y) to rotate the third rest plate piece 203 about the hinge (b) in the direction opposite to arrow (Z) to be generally in flush with the first and second rest plate pieces 201 and 202, returning the patient U to the original position of lying on his back.

After this action, the hydraulic cylinder 237 is actuated to move the rod 237*a* in the direction opposite to arrow (M) so as to pivot the semi-circular link 234 about the pin 236 in the direction opposite to arrow (N), thus moving the link 233 in the direction opposite to arrow (O), further pivoting the link 232 in the direction opposite to arrow (P) to move the lid plate 228 downward about the pin 230 in the direction opposite to arrow (Q) for liquid-tightly closing the upper opening of the toilet bowl 227.

Figure 9:
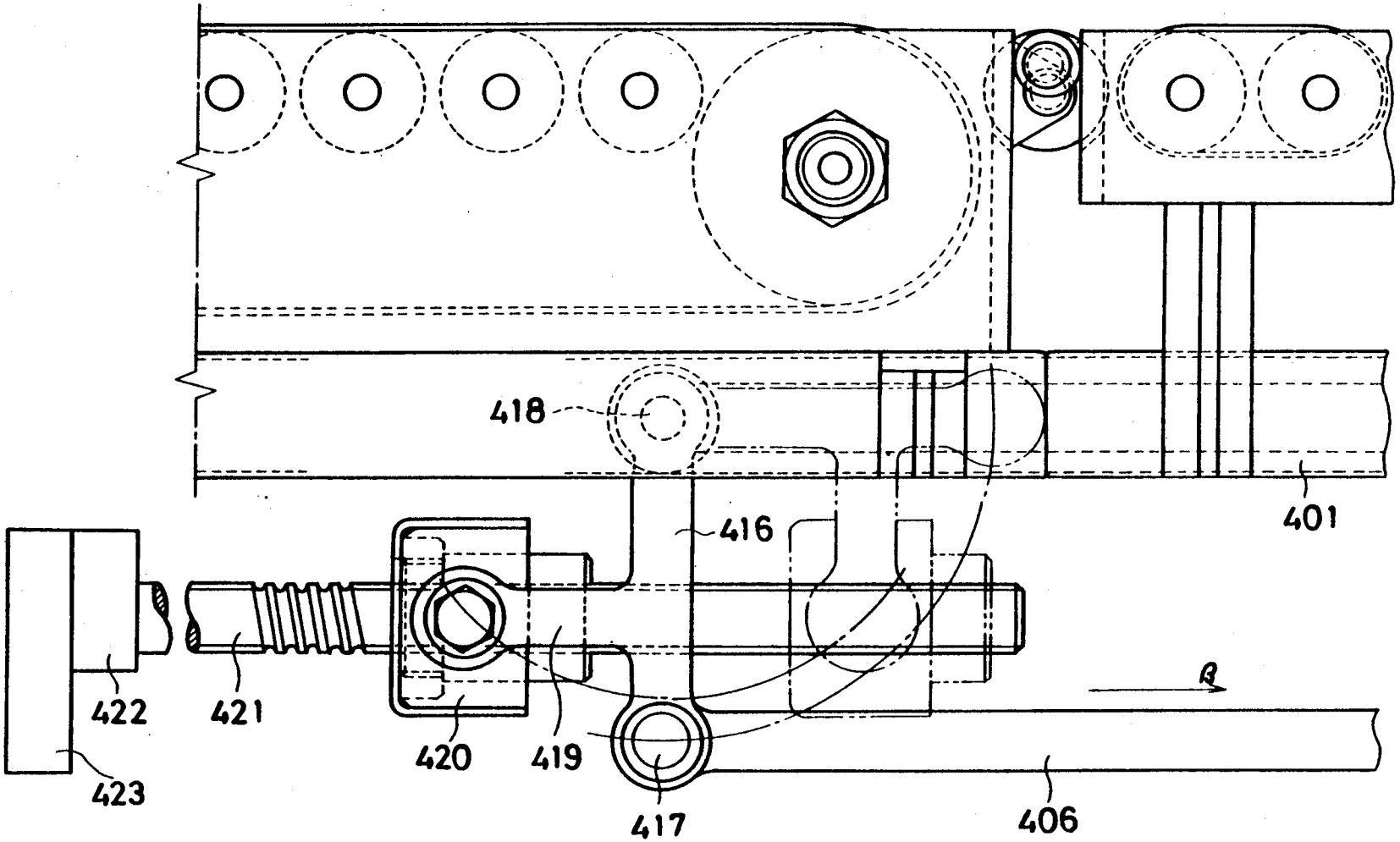
FIG. 9 through FIG. 12 are longitudinal cross sectional views showing how a closure means works.
Figure 10:
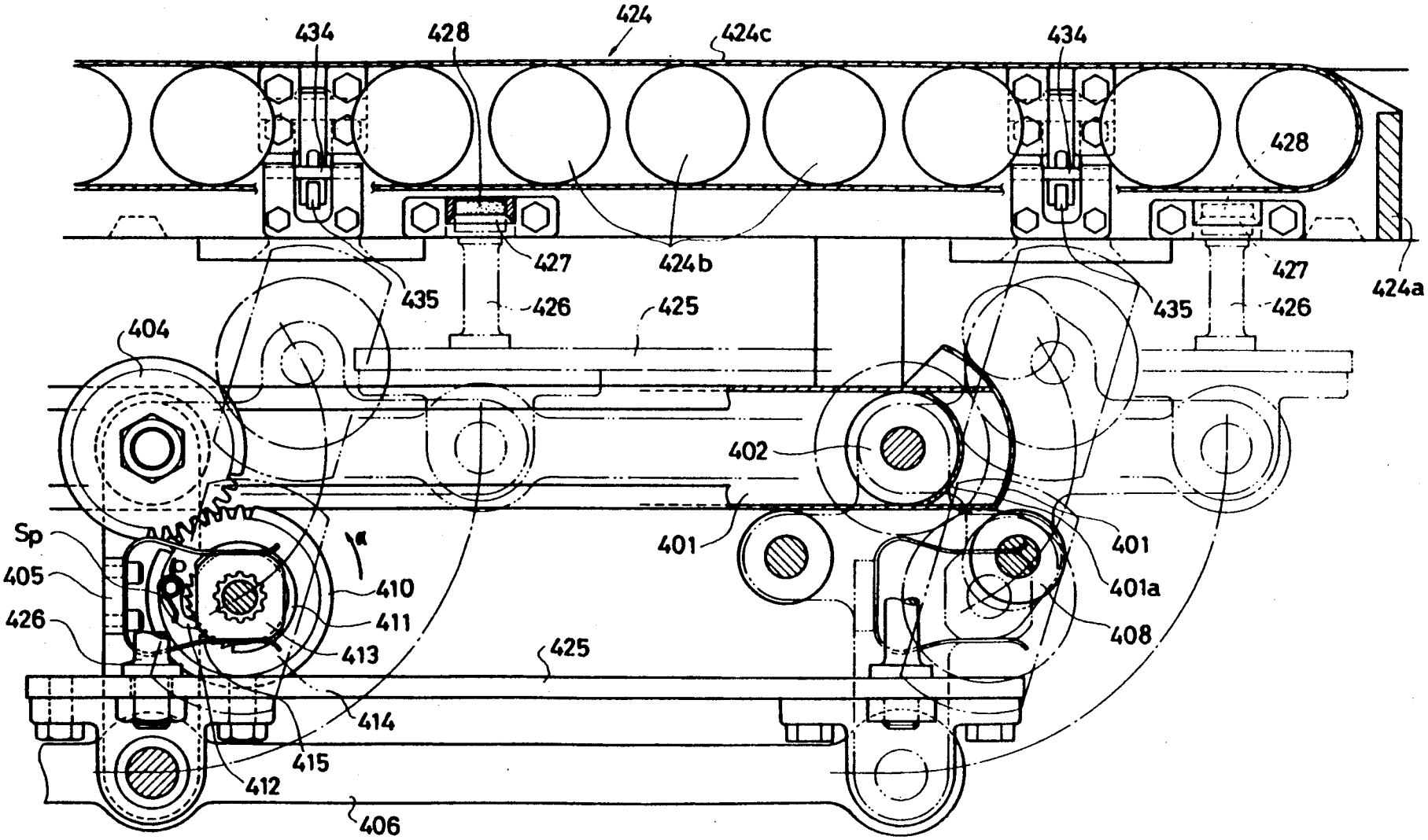

Upon closing the opening 205, the electric motor 423 moves the closure means from the soild-lined position of FIG. 9 to the phantom-lined position of FIG. 10 to locate it at the space of the opening 205.

With the entry of the closure means into the opening 205, the bar 431 temporarily oscillates in the direction opposite to arrow ($\gamma$) so as to allow the engagement of the roller 431*a* for holding the lid 424 in place. Then, the carrier alone moves downward to the original solid-lined position with the lid 424 left at the opening 205 due to the fact that the magnetic attraction between the magnets 427 and 428 is forcibly overcome. In so doing, the carrier moves in the direction opposite arrow ($\beta$B) with the lid 424 left at the opening 205 so as to return the original solid-lined position, and then the motor 423 is deenergized.

Upon desiring to soak in the bathing tub 200, the tub 200 is provided with warm water by a nozzle 269 at an appropriate level with the upper opening of the bowl 227 liquid-tightly sealed by the lid plate 228 as seen in FIG. 14. Then, the rest plate pieces changes into the chair-shaped configuration in the same manner as mentioned at the bowl movement. With this chair-shaped formation of the rest plate pieces, the patient U is carried downward, and come to be seated on the rest plate pieces to soak in the warm water with his clothes and the coverlet 67 previously removed. In this instance, the patient U may use a shower 270 of FIG. 15 if the patient U can move his arm by himself. After soaking the warm water, the patient U may perform a foot operation to rotate the lever 261 in the direction of arrow (K) so as to remove the plug 259, allowing the warm water to flow out through the drain opening 258 as seen in FIG. 8. Then, the hydraulic cylinder 220 is actuated to return the rest plate pieces from the chair-shaped position to the original position in the same manner as mentioned at the bowel movement. The patient U lying on his back at the rest plate pieces, is clothed and wear the coverlet 67, and then the rollers 201*a* and 201*b* rotate to move the belt 201*c* in the direction opposite to arrow (o) of FIG. 3 to begin carrying the patient to the bed body U. At the same time, the rollers 75 and 301 are rotated to move the belt 76 and 303 in the directions opposite to arrows (m, n) so as to move the roller 80 along the rail 78 in the direction opposite to arrow (m). Then, the rollers 301 and 302 are rotated in the direction opposite to the case in which the patient U was transferred to the rest plate pieces. This causes to move the belt 303 in the direction opposite to arrow (z), so that the mattress 66 on the belt 303 is pulled by the bands 83 to return to the original position. In this process, the patient U move by the belt 201*c* in the direction opposite to arrow (o) to rest his head on the headrest 68 at the gap (Gp). Further movement of the patient U in the direction opposite to arrow (o), the patient U comes to lie on the mattress 66 from his back portion, hip portion and legs portion in turn so as to be transferred back to the bed body as seen at phantom-lined position in FIG. 1. At this time, the rollers 201*a*, 201*b*, 75, 301 and 302 stop their movement for the cessation of the belts 201*c*, 76 and 303.

Figure 18:
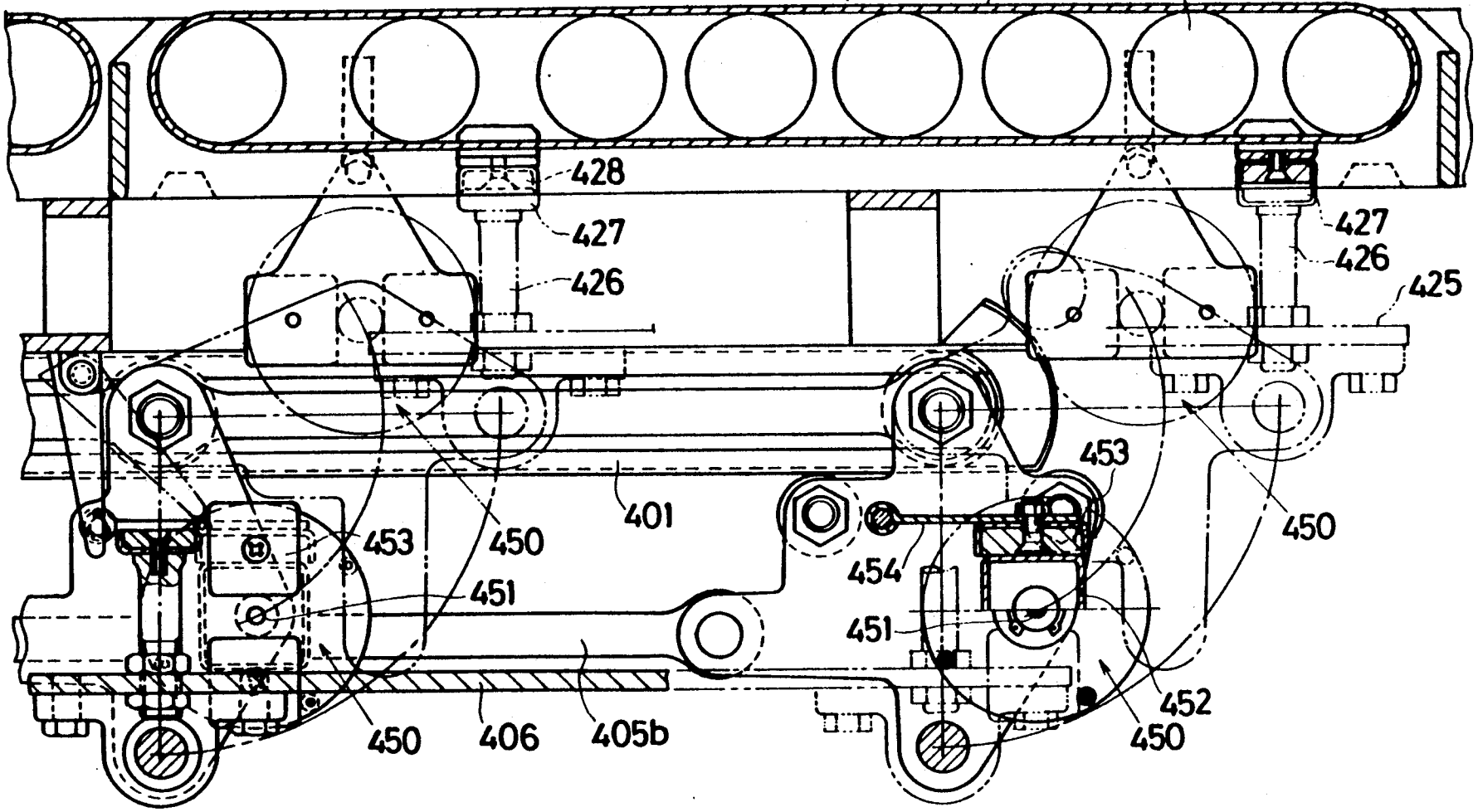
Figure 19:
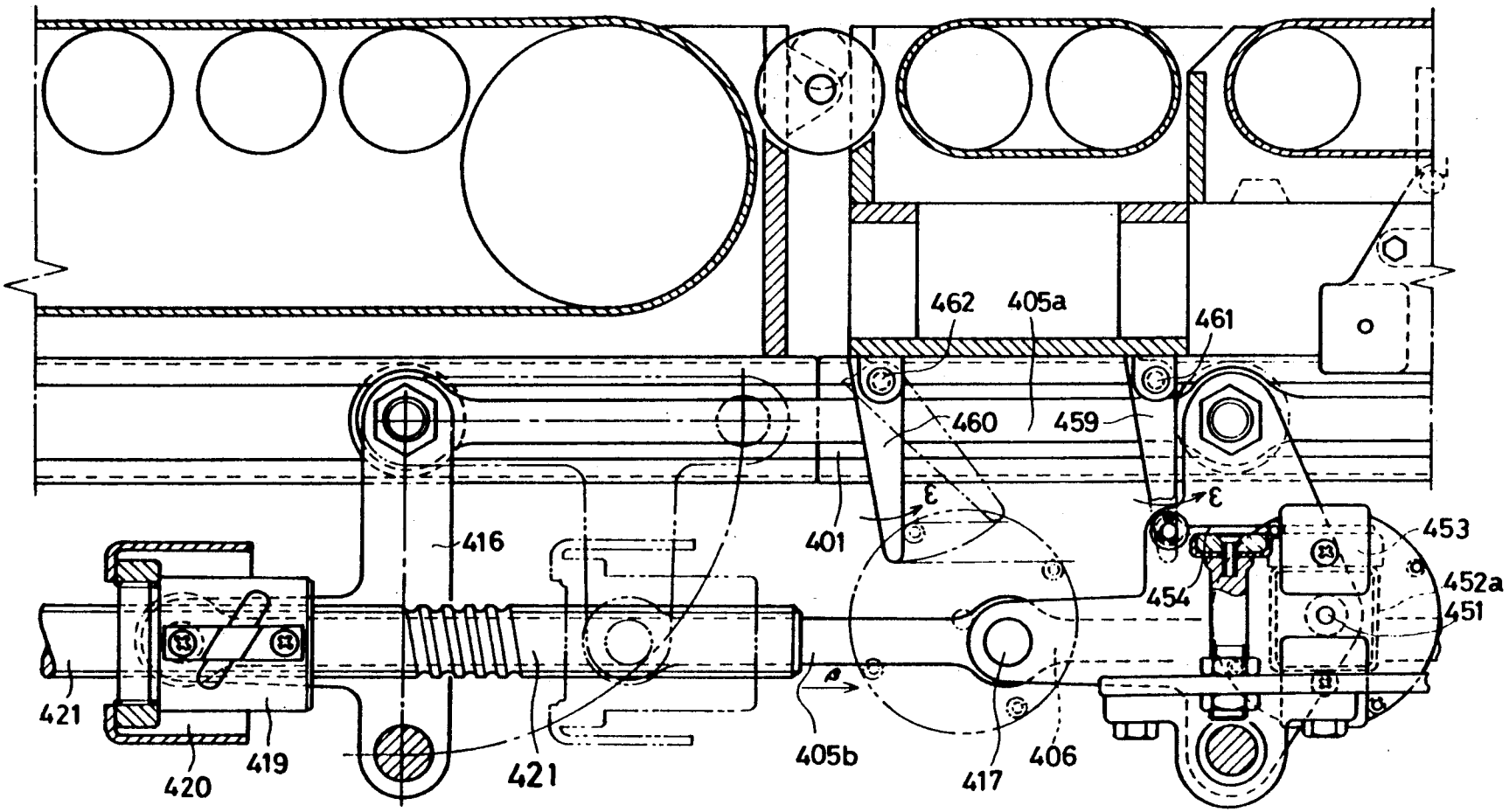

Now, referring to FIGS. 17 through 19, modified form of a latch means is described hereinafter.

The vertical link 405 are connected by upper and lower links 405*a* and 405*b* to move the enclosure means in unison. Instead of the spur gear and lift gear of the precedent embodiment, the link 405 have a wind-mill like wheel 450 rotatably supported by a shaft 451. The wheel 450 comprising two opposed discs 450*a*, 450*b*, and four pins 452 extended between the two discs 450*a* and 450*b* at regular intervals. A rectangular plate 452*a* is secured to the shaft 451 to move in union with the wheel 450. A magnetic tongue 453 is pivoted at one end to make other end stick to the plate 452*a*, and always urged to stick to the plate 452*a* by a spring 454. This allows the tongue 453 to move from one side to other side in contact with the plate 452*a* to intermittently rotate the wheel 450 by an angle of 90 degrees. The wheel 450 has paired magnet plates 456 and 457 at the disc 450*b* at an angular interval of 180 degrees. The paired magnet plates 456, 457 have each opposed plarities at the outer side. The outer side of the magnet plate 456 represents S pole, and the outer side of the magnet plates 457 represents N pole by way of example.

In the meanwhile, the latch bar 430 has a latch plate 457*a* which secures paired magnets 458*x* and 458*y* in correspondence to the magnet plates 456 and 457. The magnets 458*x* and 458*y* are arranged such that the magnets 458*x*, 458*y* and the magnet plates 456, 457 each attract and repel alternately each time the wheel 450 rotates by an angle of 90 degrees to move from the solid-lined position to phantom-lined position of FIGS. 17 and 18. A hypotenuse lug 470 is secured to an outer side of the frame 424*a* of the lid 424 to correspond to the latch bar 430, acting the oblique side as a butt portion 470*a* and serving the lower side as a lock portion 470*b*. In a state in which the opening 205 is closed by the lid 424 as seen in FIG. 17, the latch bar 470 is protracted into the opening 205 to engage with the lock portion 470*b* so as to hold the lid 424 in closed position. Two baffle bars 459 and 460 which is in an elongated hypotenuse shape, are pivoted to the rail 401 by pins 461 and 462 at the predetermined interval to depend downward under the influnce of gravity as seen in FIG. 19. The bars 459 and 460 are allowed to pivot about the pins 461 and 462 in the direction of arrows (ε) but prohibited to pivot in the direction opposite to arrow (ε).

Upon revealing the opening 205, the link 405 pivots about the shaft 403 to rotate the wheel 450 by 90 degrees to oppose the magnet plates 456 and 457 to the magnets 458*x* and 458*y* with a slight space interval while the carrier moves from the solid-lined position to the phantom-lined position in the same manner as the precedent embodiment. The magnet plates 456, 457 and the magnets 458*x*, 458*y* are each attracted to stick each other, thus moving the latch bar 430 through the plate 457*a* in the direction opposite to arrow (δ) to disengage the latch bar 430 from the lock portion 470*b* for unlocking the lid 424.

During the process in which the carrier returns to the original solid-lined position with the lid 424 stuck on the square plate 425, the pin 452 encounters the bars 459 and 460 to collide, them in turn and rotating the wheel 450 by 90 degrees each time when the bars 459 and 460 collide to rotate the wheel 450 by 180 degrees. The wheel 450 is rotated by 180 degrees when the carrier return to the initial position, so that the relationship between the magnet plates 456 and 457 is reversed when the carrier moves to the phantom-lined position of FIG. 17 in an aim to close the opening 205.

Figure 17:
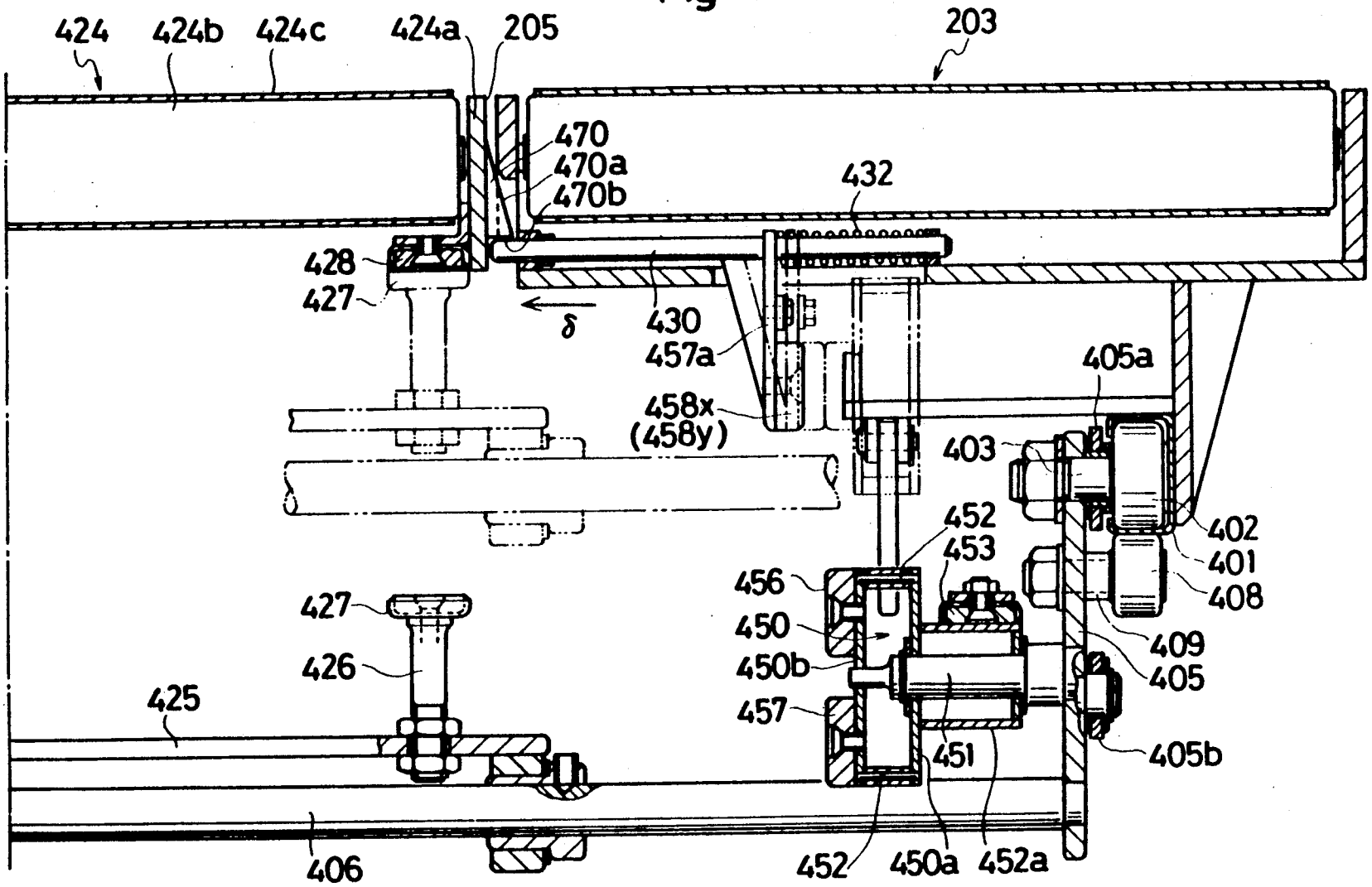
FIG. 17 through FIG. 19 are longitudinal cross sectional views showing modified forms of a latch means.

In the process in which the carrier moves to the phantom-lined position of FIG. 17 for closing the opening 205 the butt portion 470*a* of the hypotenuse lug 470 slides along the end of the latch bar 430 to temporarily push to move it in the direction opposite to arrow (δ), so that the lock portion 470*b* admits the latch bar 430 for engagement. This is because the latch bar 430 is always urged in the direction of arrow (δ) by the coil spring 432 in addition to the magnets 456, 458*x* and the magnets 457, 458*y*, each set of which exposes same polarity to expel each other. The expulsion of these magnets assists to urge the latch bar 430 through the plate 457*a* in the direction of arrow (δ).

The use of the magnets make it possible to protect the patient against an electric shock in opposition to electric magnets however often the magnets is wet with water. That the magnets are coated with plastic thin layer, should be appreciated.

The movement of the closure means may be by means of a rack and pinion, or by the use of a lazy tongs which expands and contracts alternately in the lengthwise direction. Instead of the motor 423, pynumatic or hydraulic cylinder may be used.

The bed plate pieces 7, 8 and 9 may be each comprised of only a flat plate together with the first and second rest plate pieces 210, 202, and the aprons 200*a*, 267.

In addition, the bed plate pieces may be comprised of four bed plate pieces instead of three pieces 7, 8 and 9. The angle formed between the bed plate pieces 7 and 8 (8 and 9) to provide V-shaped valley, may be altered as desired. The time period which the bed plate pieces maintain V-shaped configuration, may be predetermined by means of a timer.

The velocity which the bed plate pieces changes into V-shaped configuration, may be appropriate determined by controlling hydraulic pressure.

The bed plate pieces may be temporarily suspended at the movement once or several times during process in which the bed plates pieces completely come to V-shaped configuration.

When the bed plate pieces come to chair-shaped configuration with no warm water supplied to the tub 200, the patient U can be seated on the rest plate pieces to be examined, trimmed his hair, otherwise enjoy some kinds of activities such as reading, painting a picture or televiewing.

At the end of soaking in the warm water, the warm air from the generator 250 may be used to dry the patient's wet body.

Alternately, it is a matter of course that a discrete blower may be used for the same purpose. At this time, the warm air from the blower may be supplied from a multitude of perforation holes provided at the entire area of the rest plate pieces.

Figure 16:
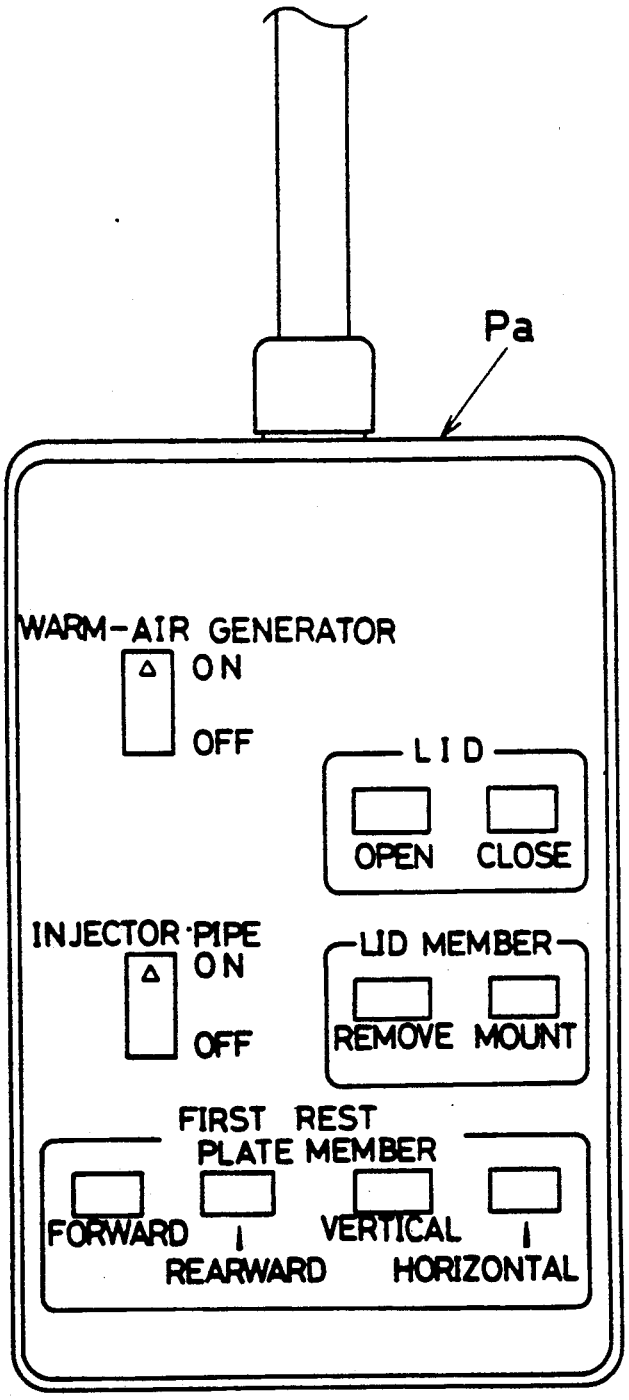
FIG. 16 is a plan view showing a control panel.

A control panel (Pa) of FIG. 16 may be used by the patient U to control the rest plate pieces, the lid 424, the lid plate 228, the injection pipe 253 and the generator 250.

The rest plate pieces may be comprised of four rest plate pieces instead of three pieces 201, 202 and 203.

Optical sensors may be employed to determine the timing of actuation of the belts when the patient U is transferred to the rest plate pieces and carried back to the bed body.

The bed body and the tub 200 may be individually used depending on the demand of installation space. In this instance, the bed plate pieces is comprised of air-permeable materials such as porous plate, sponge and a multitude of coil springs.

The bed plate pieces may be adjusted in the direction perpendicular to the Figure, so that the patient U is positively transferred to the rest plate pieces even when the patient was out of normal place while slepping.

The system according to the invention, may be used by physically normal persons, of course, including the disabled.

Further, the rest plate pieces is actuated to change into chair-shaped configuration by means of a ring and rod as described at the modified form of the bed plate pieces.

The system according to the invention, may be installed at not only homes and hospitals but other utilities as described.

It is also appreciated that the magnet 428 may be formed to have a tapered recess on the one hand, the other magnet 427 may have a cone-shaped lug which is adapted to fit into the recess for the purpose of positioning in place.

It stands as a matter of course that both the magnets 427, 428 may be formed to have flat portions which acts as sticking faces when encountered.

Further, it is noted that the rollers 203*a*, 203*b* at the thrid rest plate piece 203 in FIG. 7, may be arranged in parallel relationship as other rollers 204 of the second rest plate pieces 202.

In this case, a belt may be extended around each of a row of the rollers 203*a* and 203*b*.

Although the embodiments of the invention has been illustrated in the accompanying drawings and described in the foregoing detailed description, it will be understood that the invention is not limited to the embodiments disclosed, but is capable of numerous rearrangements, modifications and substitutions without departing from the scope of the invention.

What is claimed is;

1. An automatic care-taking system particularly for use for a bed-ridden patient comprising;

a substantially rectangular, longitudinally divided bed body defining at least first, second and third substantially planar bed plate pieces, said first and third bed plate pieces being horizontally supported at a position adjacent to a respective side edge of said second bed plate piece, one side edge of each said first and third bed plate pieces being pivotally connected to corresponding side edges of said second bed plate piece by means of a pin;

a first hydraulic cylinder having a protractable rod, the hydraulic cylinder placed under said first bed plate piece to correspond to it;

a first elongated bar, each end of which is in turn pivoted to an end of the protractable rod of said hydraulic cylinder and an underside of said first bed plate piece, the protracting movement of said rod causes to pivot said first bar in one direction so as to tilt said first and second bed plate pieces downward to form a V-shaped valley surrounded by said first and second bed plate pieces, while the retracting movement of said rod causes to pivot said first bar in the other direction so as to return said first and second bed plate pieces to the horizontal position;

a second hydraulic cylinder having a protractable rod, the hydraulic cylinder placed under said third bed plate piece to correspond to it; and a second elongated bar, each end of which is in turn pivoted to an end of the protractable rod of said second hydraulic cylinder and an underside of said third bed plate piece, the protracting movement of said second rod causes to pivot said second bar in one direction so as to tilt said second and third bed plate pieces downward to form a V-shaped valley surrounded by said second and third bed plate pieces, while the retracting movement of said second rod causes to pivot said second bar in the other direction so as to return said second and third bed plate pieces to the horizontal position.

2. A automatic care-taking system for use for bed-ridden patients comprising:

a bed body having at least three substantially planar, rectangular bed plate pieces arranged on a bed frame in planar relationship to each other, said three bed plate pieces being a first, a second and third bed plate piece;

a first pivot pivotably fixing one edge of said first bed plate piece on said bed frame;

a second pivot pivotably connecting the other edge of said first bed piece to one edge of said second bed plate piece;

a third pivot pivotably connecting the other edge of said second bed plate piece to one edge of said third bed plate piece;

a fourth pivot pivotably mounting the other edge of said third bed plate piece on said bed frame;

a plurality of support rods, each pivotably connected to said bed plate pieces, and supporting said bed plate pieces in a planar position;

driving means provided to selectively move said support rods to dispose said first and second bed plate pieces and said second and third bed plate pieces so as to each form a V-shaped valley alternately surrounded by said first and second bed plate pieces and said second and third plate pieces, the V-shaped valley surrounded by said first and second bed plate pieces providing for a person lying on said bed body with the left side and back side on said first and second bed plate pieces while the V-shaped valley surrounded by said second and third bed plate pieces providing for a person lying on said bed body with the back side and right side on said second and third bed plate pieces;

a first head rest connected between said first and second bed plate pieces, the head rest having a stud fixed at one end to said second bed plate piece and the other end pivoted to said head rest by a pin, an elongated arm plate pivoted at one end to said head rest and provided with an elongated slot at the other end, the other end of said arm plate being linked to a pin fixed to said first bed plate piece and passing through said slot so as to make said arm plate movable on said arm plate pin so that said head rest moves in parallel relationship with said first bed plate piece in combination with the V-shaped valley formed by said first and second bed plate pieces.

3. In a system as recited in claim 2, a second headrest connected between said second and third bed plate piece in a substantially identical manner to said first head rest.

4. A system as recited in claim 2, further comprising:

a bathing tub to which warm water is to be supplied when said person is transferred from said bed body to said bathing tub, said bathing tub being placed adjacent an end of said bed body;

rest plate means mounted on an upper open end of said bathing tub to lay said person transferred from said bed body, and being divided into at least first, second and third plate section which in turn corresponds to an upper half, a bottom portion and leg portion of said person;

said first and second plate section being pivotally connected by a pivot means, said second and third plate section being pivotally connected by a pivot means; and link connection means to shiftably support said rest plate means between a planar position and a chair-shaped position in which said first, second and third plate section moves downward through said pivot means into said bathing tub so as to soak said person in said warm water.

5. In a system as recited in claim 4, a second headrest connected between said first and second bed plate piece in a substantially identical manner to said first head rest.

6. A system as recited in claim 4, in which each of said first, second and third bed plate piece has a pair of rollers and a belt extended around said rollers to as to transfer said person on said bed body to said rest plate means when said belt is moved around said rollers.

7. A system as recited in claim 6, in which each of said first, second and third rest plate section has a pair of rollers and a belt extended around said rollers so as to positively admit said person being transferred from said bed body.

8. A system as recited in claim 4, in which said bathing tub has a toilet bowl at an inner bottom thereof, and said second rest plate section has an opening corresponding to that of said toilet bowl, so that said two openings meet when said rest plate means moves downward to occupy the chair-shaped position with said bathing tub empty.

9. A system as recited in claim 8, in which a closure means is provided, said closure means comprising:

a carrier means slidable mounted between said first rest plate section and said second rest plate section, the carrier means usually being positioned at said first rest plate section;

a lid means detachably placed at said opening of said second rest plate section for closure;

said carrier means for removing said lid means from said opening, and moving back to said first rest plate section with said lid means prior to said rest plate means moving downward to occupy said chair-shaped position;

said carrier means further adapted to move to said second rest plate section to place said lid means at said opening by releasing said lid means from said carrier means, and return to said first rest plate section when said rest plate means moves back from said chair-shaped position to an original position in which said rest plate means is located on the upper open end of said bathing tub in planar relationship.

10. A system as recited in claim 9, in which said lid means held at said opening by a latch means, and said carrier means removes said lid means by magnetic attraction with said latch means released when said carrier means moves to said second rest plate section to reveal said opening, and said carrier means moves to forcibly overcome said magnetic attraction with said lid means held at said opening by said latch means for closure.

11. A system as recited in claim 10, in which said latch means is adapted to be urged toward a space of said opening by a spring means, and move to retract from said opening against said spring means when said lid means is located at said opening.

12. In a system as recited in claim 11, in which said latch means having a pair of polarity opposed first magnets:

said carrier mean of said closure means having a wheel mounting a pair of polarity opposed second magnets thereon;

said second magnets encountering said first magnets to repel said first magnets to retract said latch means by magnetic repulsion when removing said lid means;

said wheel rotating by an angle of 180 degrees to reverse the polarity relationship of said second magnets when said carrier means moves back from said opening with said lid means;

said second magnets encountering said first magnets to attract said first magnets to protract said latch means toward said opening with the urging of said spring means when replacing said lid means at the opening.

13. In a system as recited in claim 12, in which a means of rotating said wheel by an angle of 180 degrees to reverse the polarity relationship of said second magnets, is a stud provided to pivot in one direction, and prohibited to pivot in another direction, said wheel having plurality of pins at regular intervals, said wheel pins encounter said stud to rotate the wheel by an angle of 180 degrees when said wheel moves back from the opening, said wheel pins encounter said stud to pivot only said stud, leaving said wheel unrotated when said wheel moves to the opening for removing said lid means.

14. In a system as recited in claim 13, in which said stud is mounted on said rest plate means.

15. A system as recited in claim 8, in which said toilet bowl has combination of a blower and a water injector to rinse and dry said person's bottom area.

16. A system as recited in claim 15, in which both outlets of said blower and said water injector are disposed adjustable in compliance with said person's bottom area.

17. A system as recited in claim 16, in which said toilet bowl has a lid to liquid-tightly seal an opening area of said toilet bowl so as to prevent said warm water from entering into said toilet bowl when said warm water is supplied to said bathing tub.

18. A system as recited in claim 17, in which said lid is hinged to said toilet bowl as to reveal said opening area when said lid is turned upward at the time of bowel movement.

19. A system as recited in claim 4, in which said third rest plate section has a plate section hinged to a free end of said third rest plate section to serve as a footrest when said rest plate means moves downward to occupy the chair-shaped position.

20. A system as recited in claim 4, in which a mattress and a coverlet are placed on said bed plate pieces, and the mattress is adapted to be accommodated under said bed body, while said coverlet adapted to be transferred to said rest plate means with said person.

* * * * *